US007883362B2

(12) United States Patent
Ichio et al.

(10) Patent No.: US 7,883,362 B2
(45) Date of Patent: Feb. 8, 2011

(54) JOINT CONNECTOR, JOINT TERMINAL AND A WIRING HARNESS WITH A JOINT CONNECTOR

(75) Inventors: Toshifumi Ichio, Yokkaichi (JP); Takeshi Tsuji, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/555,199

(22) Filed: Sep. 8, 2009

(65) Prior Publication Data

US 2010/0071953 A1 Mar. 25, 2010

(30) Foreign Application Priority Data

Sep. 11, 2008 (JP) ..... 2008-233189

(51) Int. Cl.
*H01R 31/08* (2006.01)

(52) U.S. Cl. ..... 439/511

(58) Field of Classification Search ..... 439/511, 439/507

See application file for complete search history.

(56) References Cited

U.S. PATENT DOCUMENTS

| | | | | |
|---|---|---|---|---|
| 4,607,899 | A | 8/1986 | Romine et al. | |
| 4,883,430 | A * | 11/1989 | Siemon et al. | 439/510 |
| 5,061,196 | A * | 10/1991 | Weston et al. | 439/189 |
| 5,201,667 | A | 4/1993 | Endo et al. | |
| 5,496,188 | A * | 3/1996 | Okamura et al. | 439/189 |
| 6,276,964 | B1 | 8/2001 | Shinozaki | |
| 7,241,168 | B2 * | 7/2007 | Sakurai et al. | 439/511 |
| 7,306,486 | B2 | 12/2007 | Takeda et al. | |
| 7,351,085 | B2 * | 4/2008 | Tamagawa et al. | 439/189 |
| 7,377,824 | B2 | 5/2008 | Mizutani et al. | |
| 7,476,113 | B2 * | 1/2009 | Tamagawa et al. | 439/189 |
| 2006/0205270 | A1 | 9/2006 | Sakurai et al. | |
| 2007/0246241 | A1 | 10/2007 | Peterson et al. | |

FOREIGN PATENT DOCUMENTS

| | | |
|---|---|---|
| DE | 19608168 | 9/1997 |
| EP | 1930987 | 6/2008 |

* cited by examiner

*Primary Examiner*—Gary F. Paumen
(74) *Attorney, Agent, or Firm*—Gerald E. Hespos; Michael J. Porco

(57) ABSTRACT

A joint connector has a housing (10) with cavities (11) capable of accommodating mating terminals (30) and a joint terminal (40) with a strip-like base (41) and terminal portions (42) projecting at specified intervals from the strip-like base (41). Insertion openings (18) are formed in a part of the housing (10) before the cavities (11) and communicate with the cavities (11). The joint terminal (40) is mounted into the housing (10) from the front with the terminal portions (42) in the lead. The strip-like base (41) has engaging holes (43) located between the terminal portions (42). Engaging projections (19A) project from a resilient wall (19) continuous with left and right side wall portions (12D) of the housing (10) and engage with the engaging holes (43).

6 Claims, 23 Drawing Sheets

JOINT CONNECTOR, JOINT TERMINAL AND A WIRING HARNESS WITH A JOINT CONNECTOR

BACKGROUND OF THE INVENTION

1. Field of the Invention

The invention relates to a joint connector for shorting terminals, to a joint terminal and to a wiring harness.

2. Description of the Related Art

U.S. Pat. No. 7,377,824 discloses a joint connector with a housing that has cavities for accommodating mating terminals and a joint terminal. The joint terminal has a strip-like base and terminal portions project at specified intervals from a strip-like base.

The joint terminal is held in the housing in a posture so that the terminal portions project into the cavities from a front wall of the housing. Press-fitting portions project at a rear of the joint terminal and are press-fit into a front end portion of the housing to fix the joint terminal in the housing. However, the front wall of the housing needs a press-fitting margin to accommodate the press-fitting portions of the joint terminal. The required press fitting margin competes with commercial demands for a smaller connector.

The invention was developed in view of the above situation and an object thereof is to allow a joint connector to be miniaturized.

SUMMARY OF THE INVENTION

The invention relates to a joint connector with a housing formed with cavities for accommodating mating terminals. The joint connector also has at least one joint terminal with a strip-like base and terminal portions that project at specified intervals from the base. Insertion openings are formed in a part of the housing corresponding to the cavities and communicate with the cavities. The joint terminal is to be mounted into the housing in a mounting direction with the terminal portions in the lead. The strip-like base is formed with at least one engaging hole offset from the terminal portions, and at least one engaging projection projects from a resilient wall of the housing for engaging the respective engaging hole.

The joint terminal is mounted into the housing in the mounting direction and deforms the resilient wall. The resilient wall resiliently restores when the joint terminal reaches a proper position and the engaging projections enter the engaging holes in the base to fix the joint terminal in the housing. Thus, the housing does not require a conventional press-fitting portion and the joint connector can be miniaturized by that much. Further, the engaging holes are offset with respect to the terminal portions. Therefore, the engaging projections of the housing are positioned between paths for the terminal portions when the joint terminal is mounted, and the terminal portions do not slide in contact with the engaging projections when the joint terminal is inserted.

The engaging projections preferably project from a resilient wall continuous with left and right side walls of the housing.

The joint terminal may be produced by press-working a conductive (preferably metal) plate, and feed holes are used to feed the conductive plate during press working. A larger conductive plate is necessary to provide both the feed holes and the engaging holes and additional processing is required to form both the feed holes and the engaging holes. However, the feed holes are utilized as the engaging holes, and separate engaging holes are not necessary. As a result, there is no increase of material or labor.

A cover wall may be provided at a side of a resilient wall substantially opposite to the engaging projections via a clearance for permitting resilient deformation of the resilient wall.

At least one column may be provided between the resilient wall and the cover wall to reduce the span of the resilient wall. Thus, the thickness of the resilient wall can be reduced to miniaturize the joint connector further.

The entire strip-like base portion preferably is accommodated in housing when the joint terminal is mounted at the proper position and the terminal portions project substantially entirely into the cavities.

The invention also relates to the above-described joint terminal independent of the housing.

The invention further relates to a wiring harness with the above-described joint connector.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
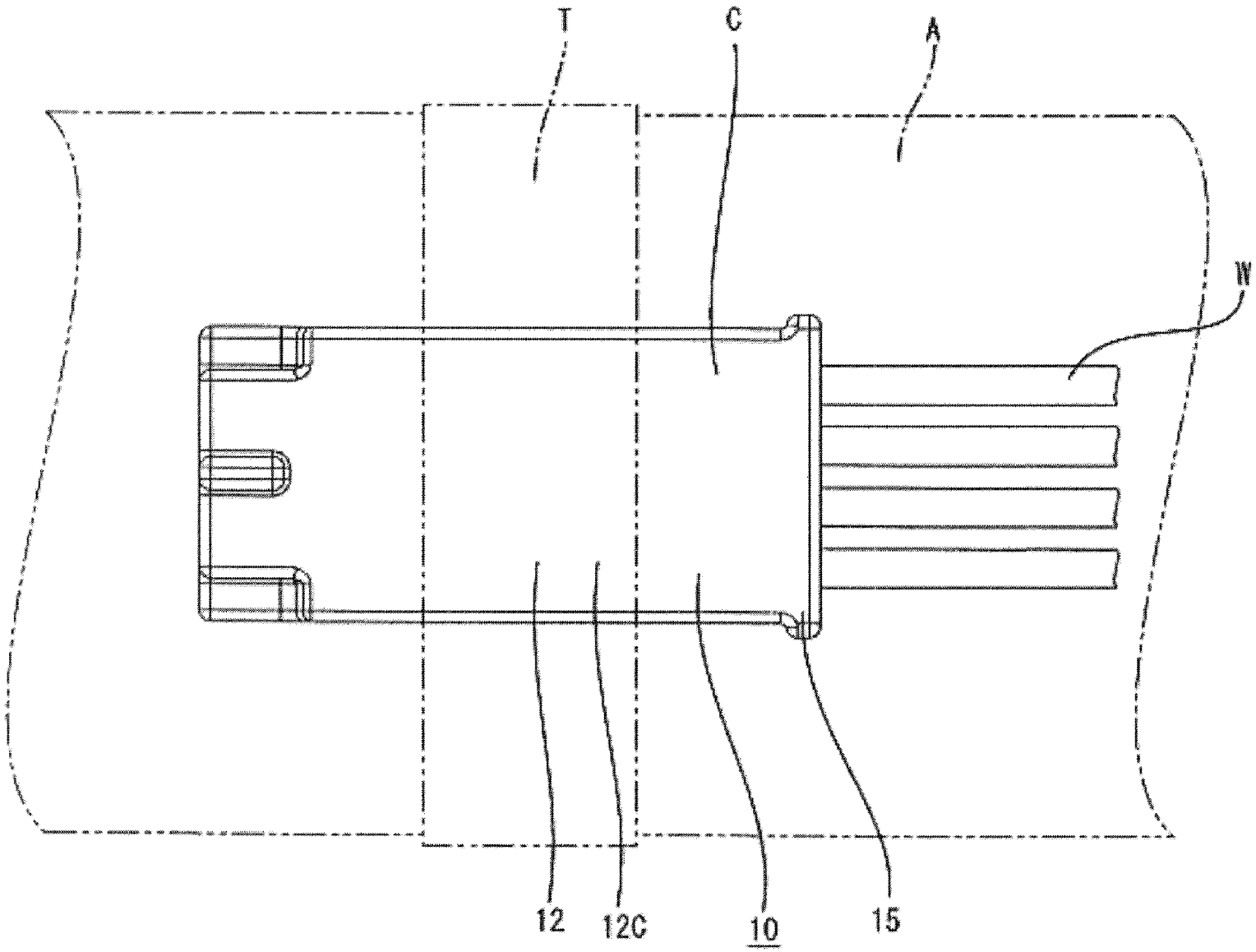
FIG. 1 is a schematic diagram showing a state where a joint connector is fixed to a wiring harness according to a first embodiment.
Figure 2:
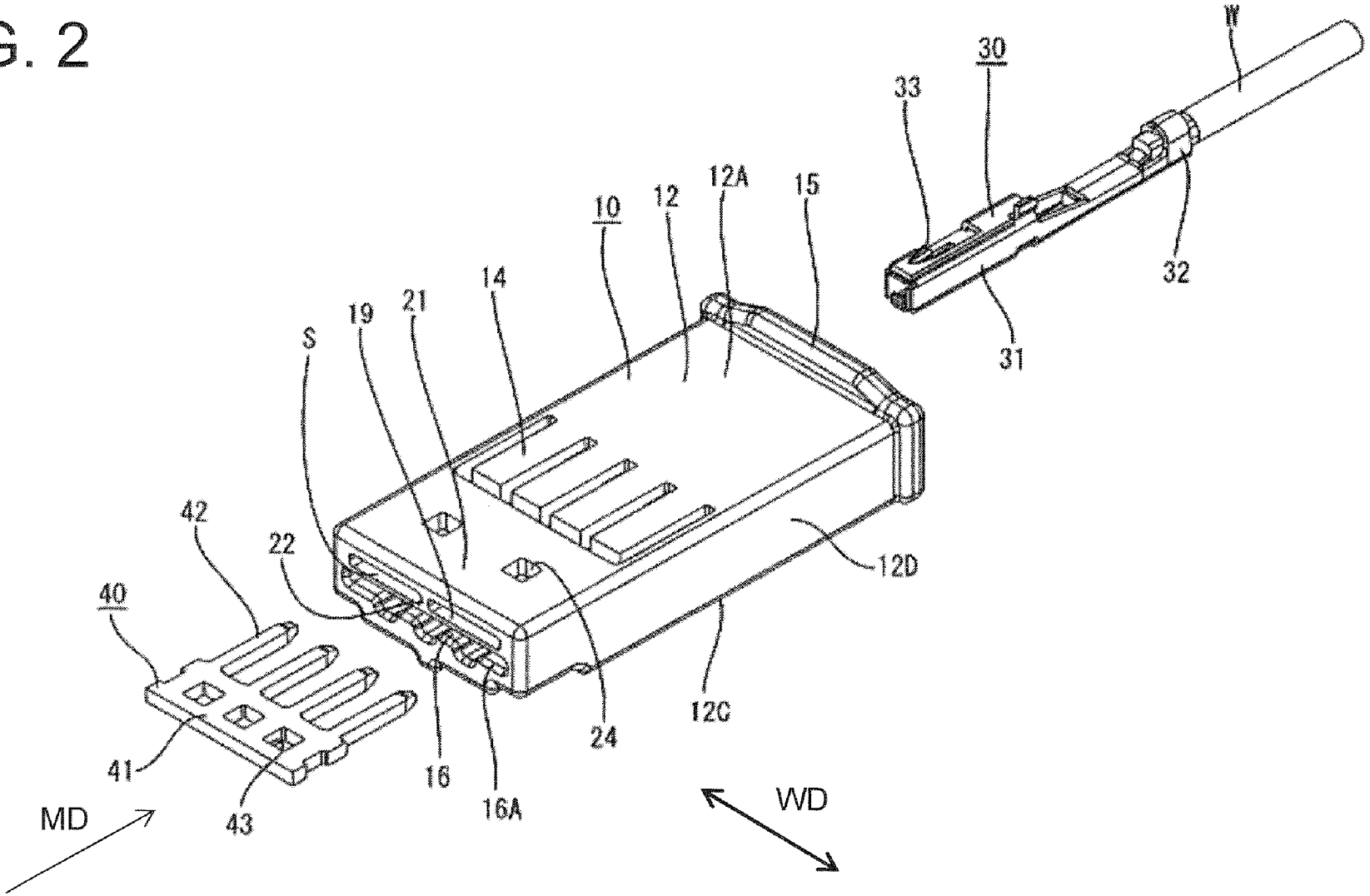
FIG. 2 is a perspective view showing a connector housing, a joint terminal and a mating terminal.
Figure 3:
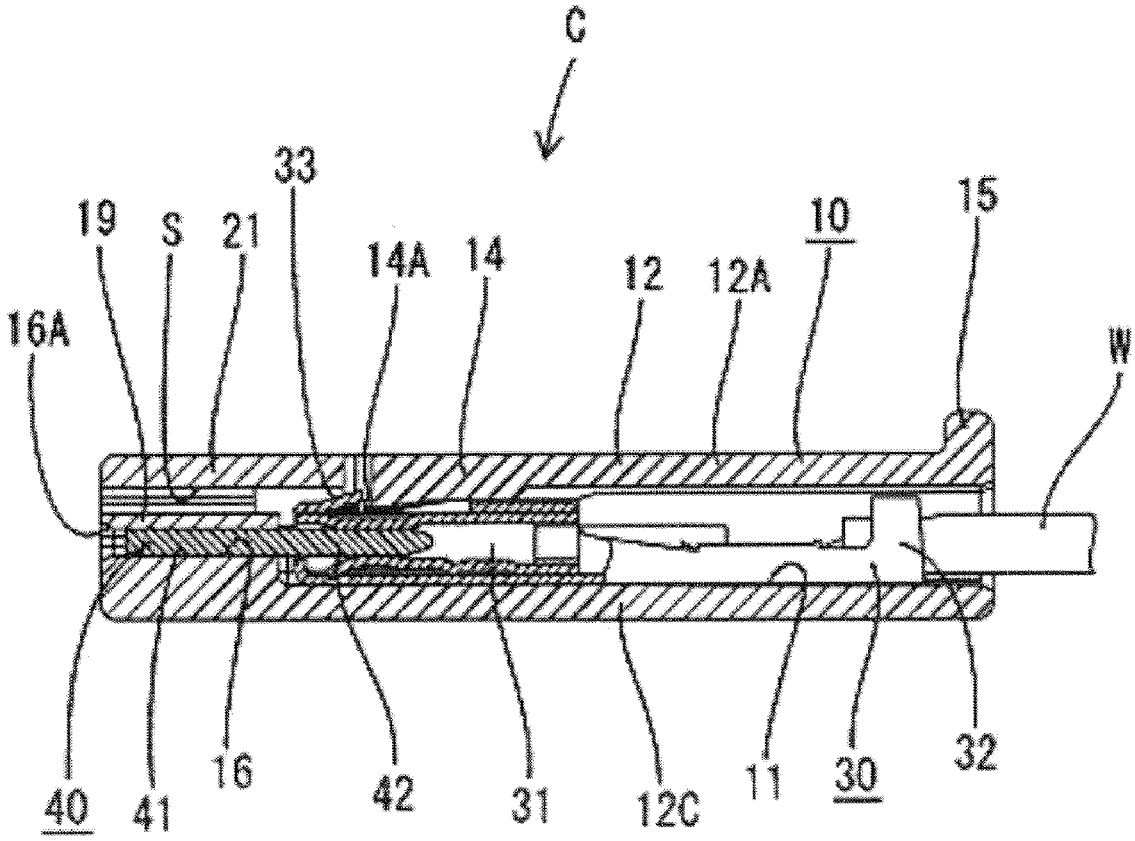
FIG. 3 is a side view in section showing a state where the mating terminal is inserted in the joint connector.

A joint connector according to a first embodiment of the invention is identified by the letter C in FIGS. 1 to 12. The joint connector C is to be fixed to a main line A of a wiring harness by a fixing member, such as by winding a tape T, using a clamp and/or a cable tie or the like (see FIG. 1). The joint connector C has a housing 10 formed internally with cavities 11 for accommodating mating terminals 30, and a joint terminal 40 for electrically connecting and shorting the mating terminals 30 in the cavities 11 with each other. In the following description, the left upper side, right upper side, upper side and lower side of FIG. 2 are referred to respectively as front, rear, upper and lower sides of the respective constituent members.

The housing 10 is made e.g. of synthetic resin and has a substantially flat box shape. The cavities 11 are and four cavities 11 are formed substantially side by side in a width direction WD of the housing 10. Each cavity 11 is long and narrow in forward and backward directions and has a substantially rectangular cross-sectional shape slightly larger than a connecting portion 31 of the terminal 30 that is inserted into the cavity 11 from behind. The housing 10 has an outer wall 12 that surrounds the cavities 11. The outer wall 12 has an upper wall portion 12A that defines the upper part of each cavity 11, a lower wall portion 12C that defines the lower part of each cavity 11 and two side wall portions 12D that define sides of the two outermost cavities 11. Dividing walls 13 are arranged in the housing 10 and partition the adjacent cavities 11 (see FIG. 8). The joint connector C is fixed to the main line A in a posture so that the upper wall portion 12A touches the main line A of the wiring harness.

Four locking lances 14 are formed substantially side by side in the upper wall portion 12A of the outer wall 12 of the housing 10. Each locking lance 14 is cantilevered substantially forward and is resiliently deformable inward and outward in directions substantially normal to an insertion direction of the terminals 30 into the housing 10. A lock 14A is formed near the free front end of each locking lance 14. The lock 14A projects into the cavity 11 for engaging an engageable portion 33 of the terminal 30 and retaining the terminal 30 in the cavity 11. The engageable portion 33 of the terminal 30 moves onto the lock 14A as the terminal 30 is being inserted into the cavity 11, and deforms the locking lance 14 up and out. The locking lance 14 resiliently returns toward its natural state to lock the terminal 30 when the terminal 30 is inserted to a proper position. No part of the locking lance 14 projects out from the outer wall 12 of the housing 10 when the locking lance 14 is in the natural state. More particularly, the outer surface of the locking lance 14 and the outer surface of the outer wall 12 of the housing 10 form a substantially flat surface.

A rib 15 is at the rear end of the housing 10 and extends from the upper wall portion 12A to the opposite side wall portions 12D of the housing 10.

Each terminal 30 is made of an electrical conductive (preferably metal) plate material and is shaped to be long and narrow in forward and backward directions. The connecting portion 31 is at the front end of the terminal 30 and is to be connected with the joint terminal 40. A wire barrel 32 is at the rear end of the terminal 30 and is to be crimped, bent or folded into connection with an end portion of a wire W of the wiring harness.

The connecting portion 31 is a substantially rectangular tube having open front and rear ends. A terminal portion 42 of the joint terminal 40 can be inserted into the connecting portion 31 from the front for electrical connection. The engageable portion 33 projects from a position close to the front end of the connecting portion 31 and the lock 14A of the locking lance 14 is engageable with the engageable portion 31 from behind (see FIG. 3).

Figure 4:
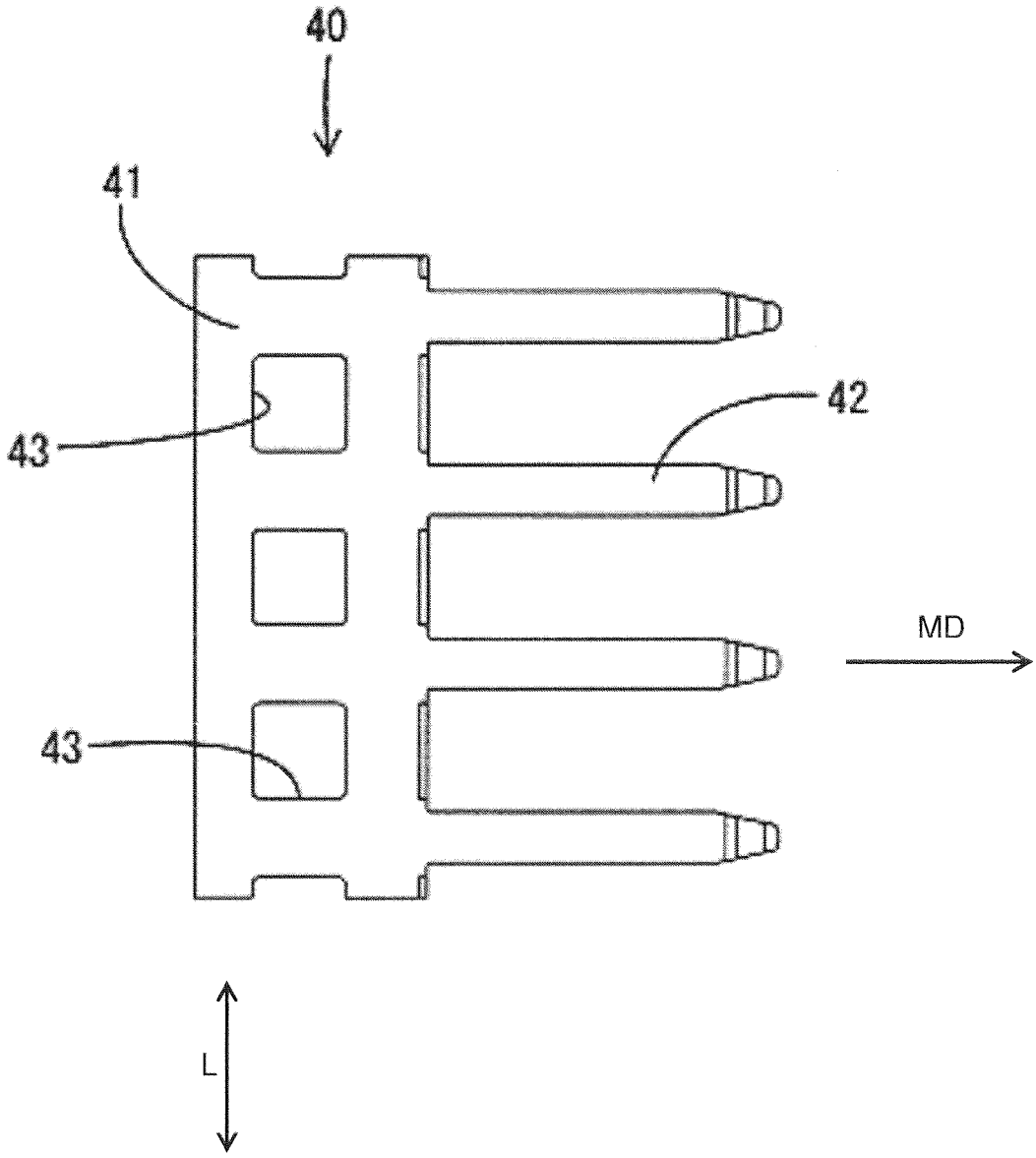
FIG. 4 is a plan view of the joint terminal.

The joint terminal 40 has a strip-like base 41 that extends in a longitudinal direction L and terminal portions 42 that project substantially perpendicularly at specified intervals from the base 41 (see FIG. 4).

The joint terminal 40 is produced by press working a metal plate material or blank to define substantially rectangular feed holes 51 in a strip-like carrier 52 of the metal plate material that will define the base 41. The feed holes 51 are aligned in a substantially linear array extending in the longitudinal direction L. Additionally, the feed holes 51 are disposed at specified pitches and are used to feed the metal plate material during the press working.

Figure 5:
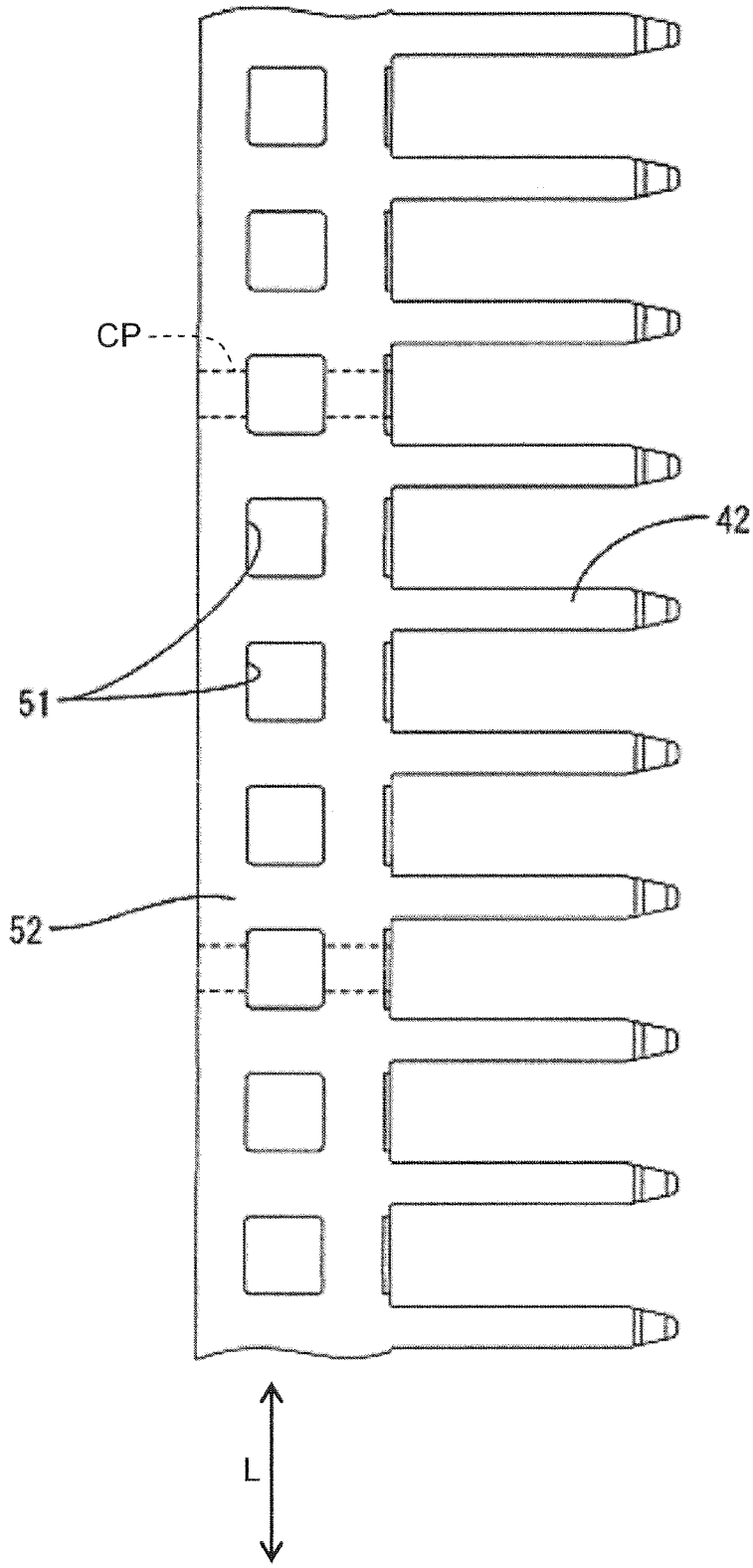
FIG. 5 is a plan view showing a state before a carrier is cut.

The metal plate material is punched out by a press to have the shape shown in FIG. 5, including tab-like terminal portions 42 that project from the strip-like carrier 52 in directions substantially normal to the direction L of the feed holes 51. The terminal portions 42 project from one of the opposite lateral edges of the carrier 52 and are located at positions between the adjacent feed holes 51 and at substantially the same pitches as the feed holes 51.

Subsequently, the carrier 52 is cut at specified cutting positions CP shown by dotted lines in FIG. 5. The cutting positions CP align with middle parts of selected feed holes 51. In this embodiment, four terminal portions 42 are disposed between adjacent cutting positions CP.

The joint terminal 40 formed by the above-described process has the substantially rectangular strip-like base 41 that is long in the juxtaposition direction L of the terminal portions 42. Additionally, the terminal portions 42 are arranged at substantially the same pitches as the cavities 11. Still further, the terminal portions 42 are substantially parallel to one another and substantially perpendicular to the longitudinal direction L of the strip-like base 41.

Three feed holes 51 are formed in the base 41 of illustrated the joint terminal 40 at positions between the terminal portions 42. More generally, the joint terminal 40 having N terminal portions 42 has N−1 feed holes 51 in the base 41. Two of the N−1 (e.g. three) feed holes 51 are at the opposite ends in the juxtaposition direction L and also define engaging holes 43 engageable with engaging projections 19A to be described later (see FIG. 4).

The engaging holes 43 are substantially identical rectangular holes that penetrate the base 41 in a plate thickness direction. The width of each engaging hole 43 in the direction L is slightly smaller than the interval between the adjacent terminal portions 42, and each engaging hole 43 is located substantially in the widthwise center between the adjacent terminal portions 42. In other words, each engaging hole 43 is at a part of the strip-like base 41 displaced or offset from extensions of the terminal portions 42.

The joint terminal 40 is mounted into a front end portion of the housing 10 with the terminal portions 42 in the lead so that the terminal portions 42 project backward. The terminal portions 42 project into the corresponding cavities 21 when the joint terminal 40 is mounted in the housing 10.

A forwardly open mounting portion 16 is formed in the front end of the housing 10 before the cavities 11. The mounting portion 16 has a rectangular shape that conforms with the outer shape of the strip-like base 41 when viewed from above (see FIG. 12) and has a height substantially equal to the plate thickness of the joint terminal 40. Thus, the mounting portion 16 is configured for receiving the strip-like base 41 of the joint terminal 40. A first tapered portion 16A is formed at the front opening edge of the mounting portion 16 and is shaped to widen toward the front.

A partition wall 17 is formed at the front of the housing 10 and defines a partition between the mounting portion 16 and the cavities 11. Insertion openings 18 are formed in the partition wall 17 and communicate with the mounting portion 16 and the respective cavities 11. The insertion openings 18 are formed at four positions of the partition wall 17 corresponding respectively to the widthwise centers of the corresponding cavities 11. Each insertion opening 18 has a substantially rectangular shape conforming to the outer shape of the terminal portions 42 of the joint terminal 40 and penetrate the partition wall 17 in forward and backward directions. Second tapered portions 18A are formed at the front edges of the terminal-portion insertion openings 18 and widen the terminal-portion insertion openings 18 toward the front.

A resilient wall 19 is provided above the mounting portion 16. The resilient wall 19 has wall surfaces that extend substantially in a mounting direction MD of the joint terminal 40 and have a substantially rectangular shape long in the width direction WD of the housing 10 when viewed from above or below (see FIG. 8). Opposite longitudinal end edges of the resilient wall 19 are substantially continuous with the front ends of the left and right side wall portions 12D of the housing 10, and the rear end of the resilient wall 19 is continuous with the partition wall 17. Two engaging projections 19A project toward the mounting portion 16 from the lower surface of the resilient wall 19. The engaging projections 19A are provided substantially side by side in the longitudinal direction of the resilient wall 19 and are located before and adjacent to the two outermost dividing walls 13. The engaging projections 19A are engageable with the engaging holes 43 of the joint terminal 40.

Each engaging projection 19A is substantially rectangular when viewed from below (see FIG. 12) and is slightly smaller than the engaging holes 43. Additionally, each engaging projection 19A is slightly wider than the dividing walls 13 and narrower than the parts of the partition wall portion 17 left between the adjacent terminal-portion insertion openings 18. The rear end surfaces of the engaging projections 19A are substantially at right angles to the lower surface of the resilient wall 19 and the front end surfaces thereof are inclined to gradually reduce a projecting distance toward the front.

A cover 21 is defined at a front of the upper wall portion 12A and above the resilient wall 19. Hence, the cover 21 is at a side of the resilient wall 19 opposite the engaging projections 19A. A clearance S is defined between the cover 21 and the resilient wall 19 for permitting resilient deformation of the resilient wall 19. The cover 21 has a thickness substantially equal to the thickness of other parts of the upper wall portion 12A. Additionally, the cover 21 is parallel to the resilient wall 19 and has a substantially flat outer surface that is substantially coplanar with the remainder of the upper wall portion 12A.

The resilient wall 19 preferably is thinner than the upper wall portion 12A and most preferably less than half the thickness of the upper wall portion 12A. The distance between the resilient wall 19 and the upper wall portion 12A in the clearance S is substantially equal to or slightly larger than a projecting distance of the locks 14A of the locking lances 14 and larger than the thickness of the resilient wall 19.

Figure 6:
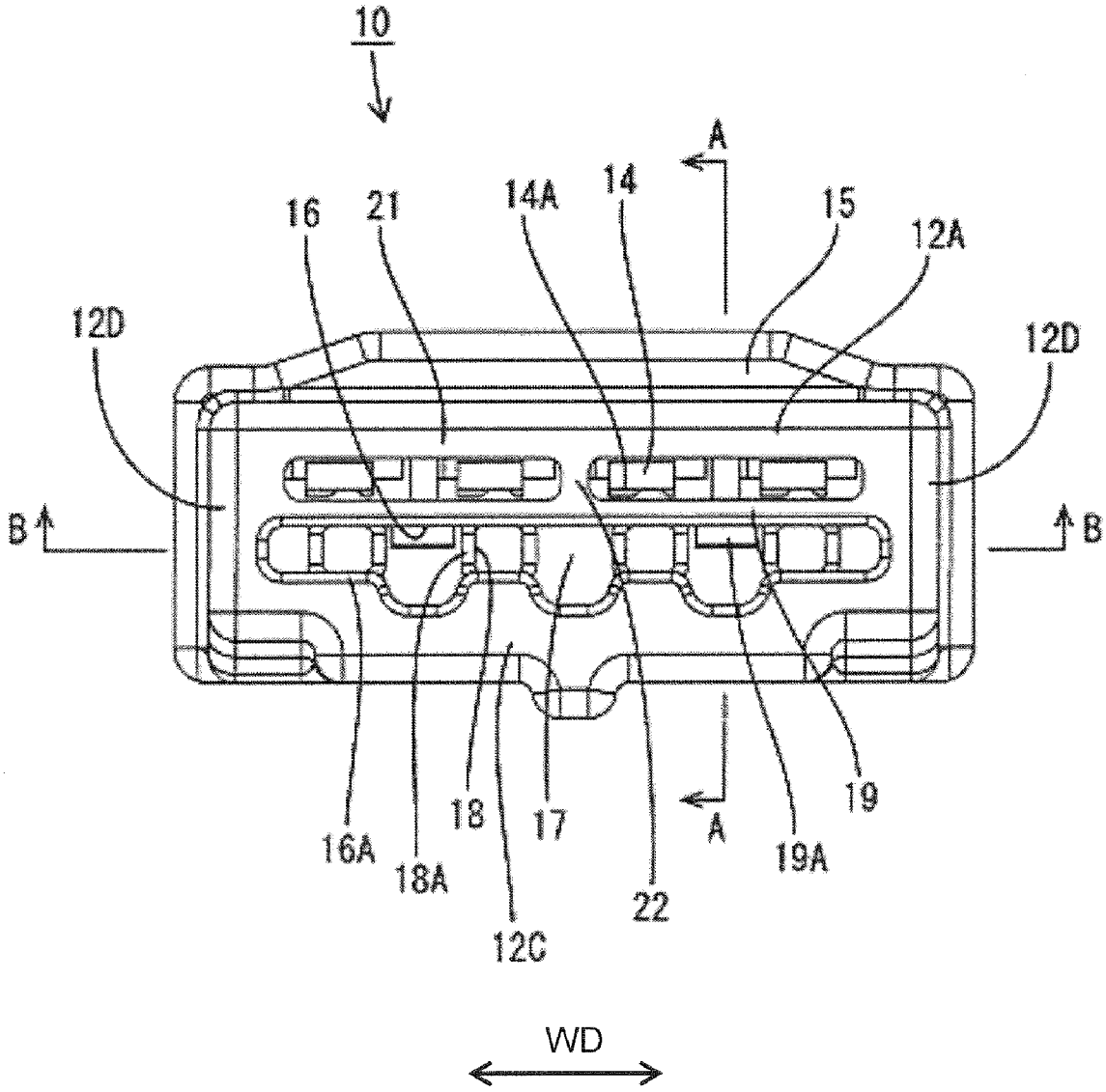
FIG. 6 is a front view of the connector housing.
Figure 7:
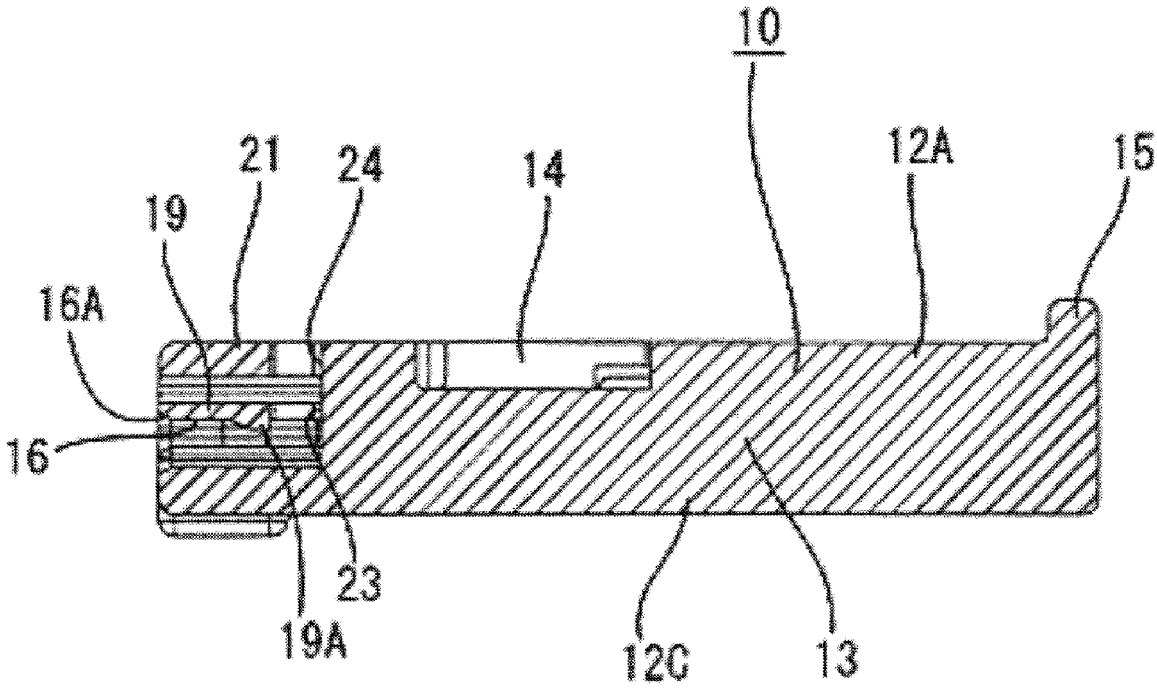
FIG. 7 is a section along A-A of FIG. 6.

A column 22 is provided between the resilient wall 19 and the cover 21 (see FIG. 6). The column 22 extends substantially in forward and backward directions at a widthwise central position of the resilient wall 19. A dimension of the column 22 in the width direction WD is slightly less than the width of the dividing walls 13.

Figure 8:
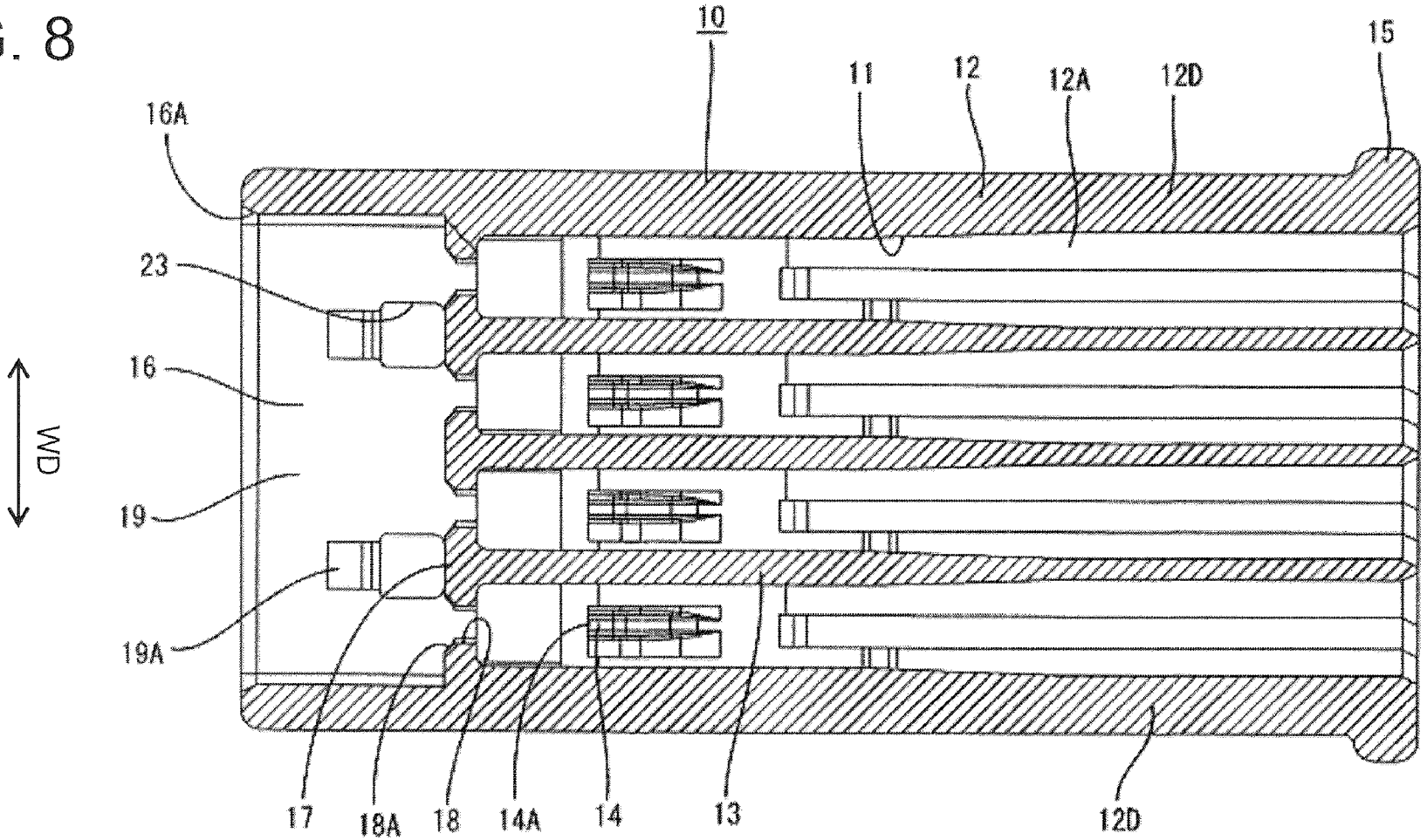
FIG. 8 is a section along B-B of FIG. 6.
Figure 9:
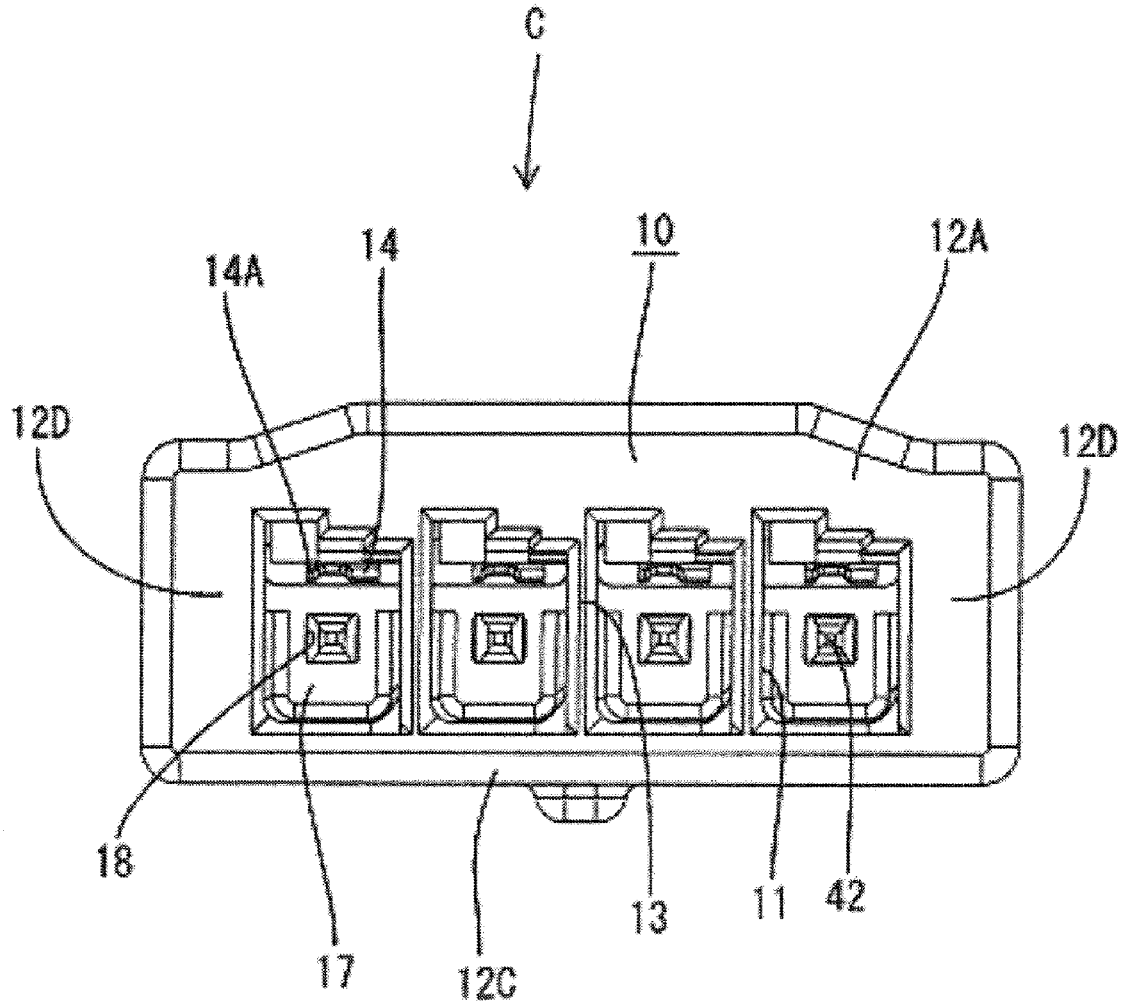
FIG. 9 is a rear view of the joint connector.
Figure 10:
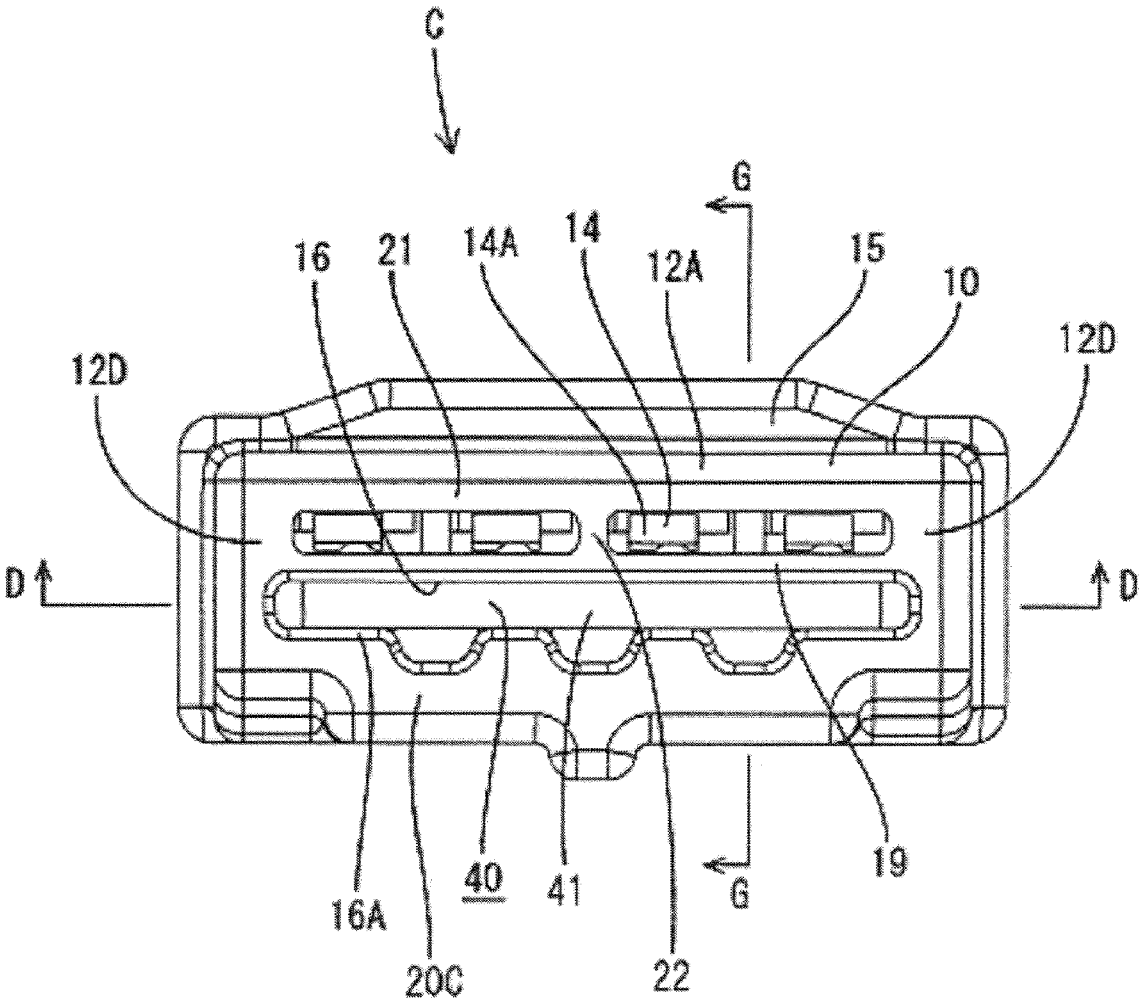
FIG. 10 is a front view of the joint connector.
Figure 11:
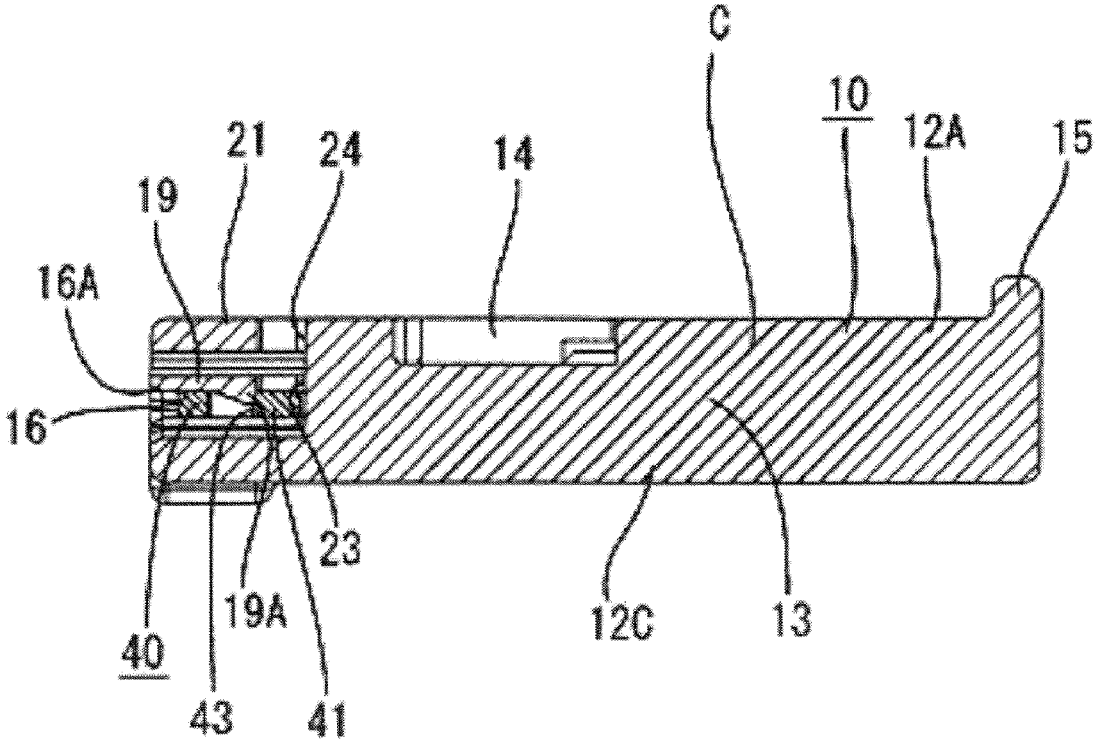
FIG. 11 is a section along G-G of FIG. 10.
Figure 12:
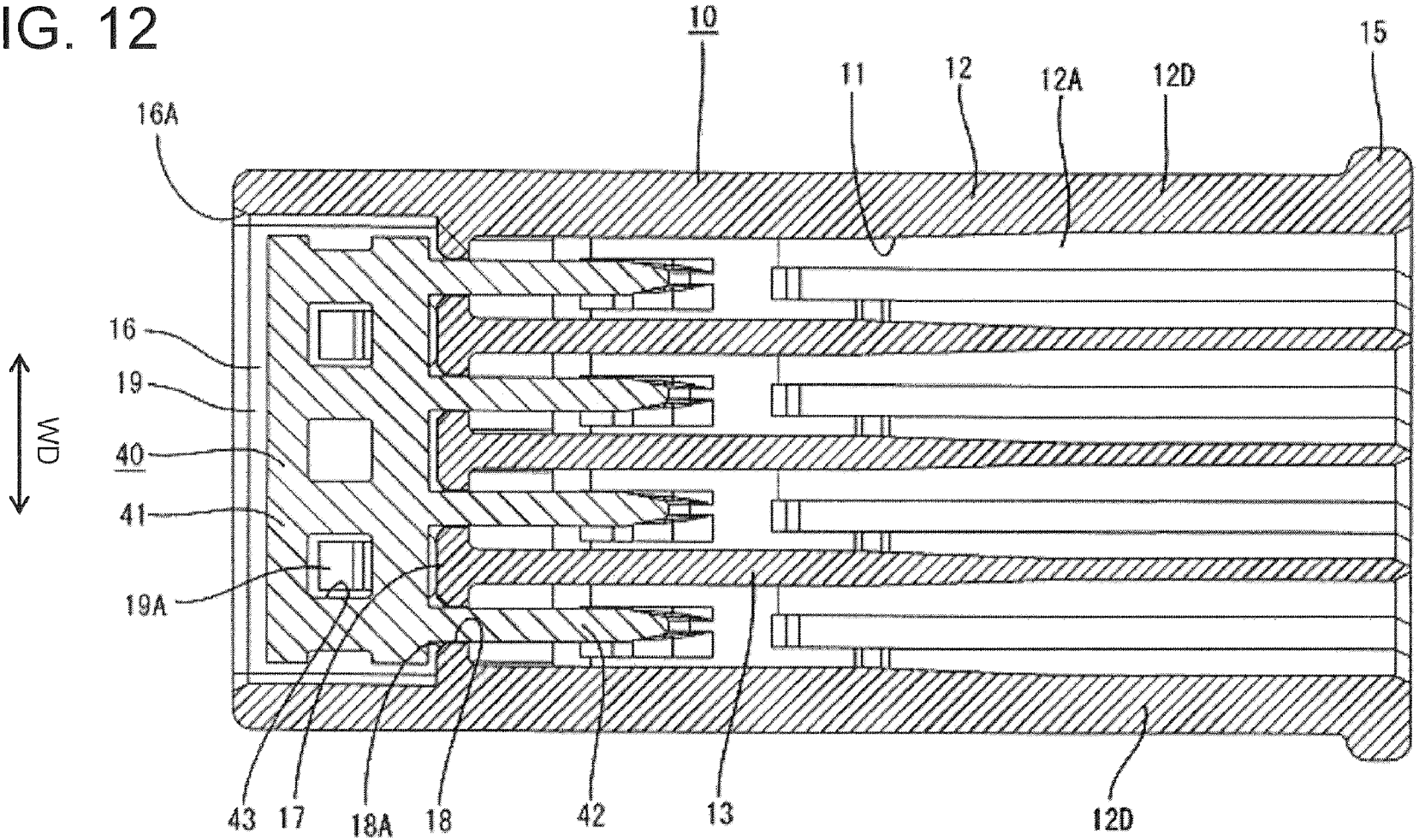
FIG. 12 is a section along D-D of FIG. 10.
Figure 13:
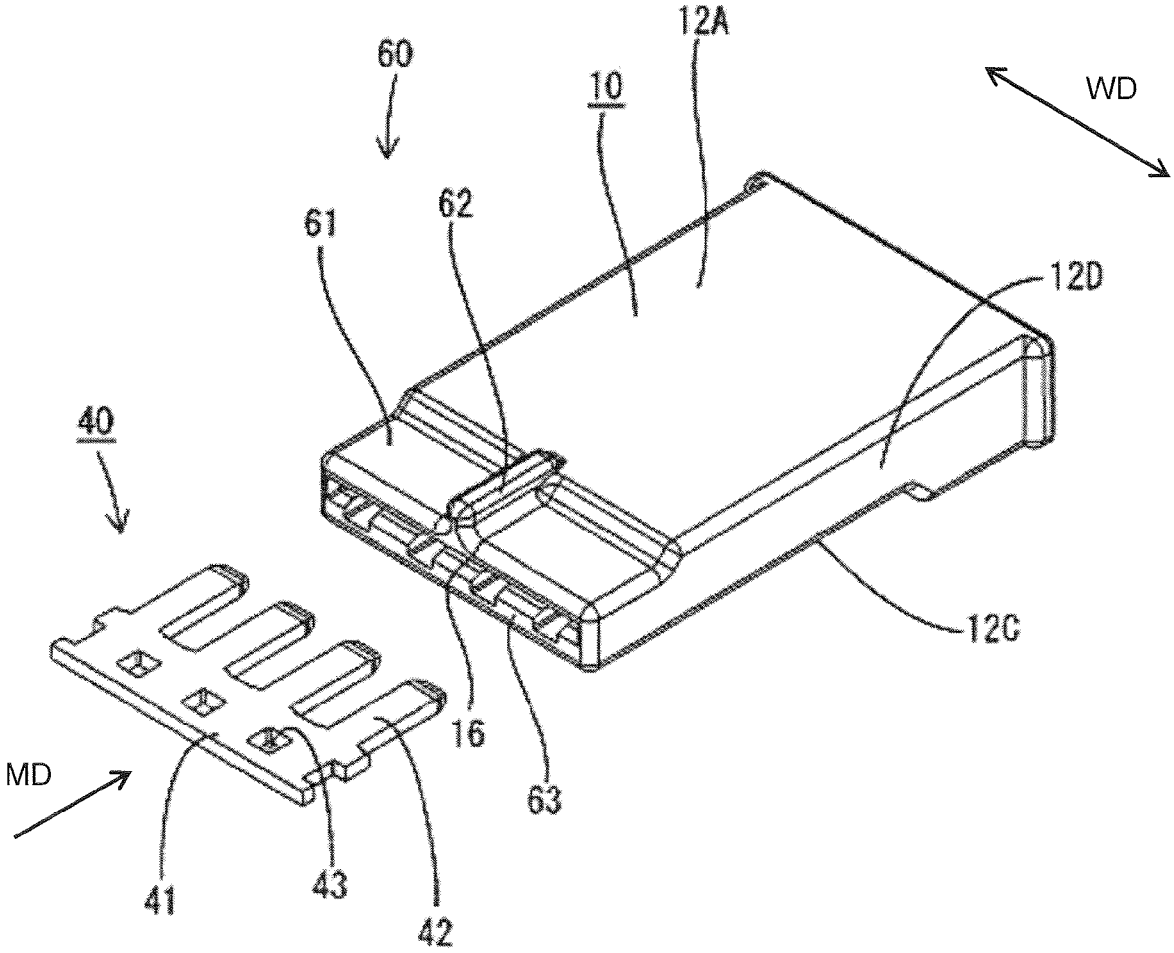
FIG. 13 is a perspective view showing a connector housing and a joint terminal of a joint connector according to a second embodiment.
Figure 14:
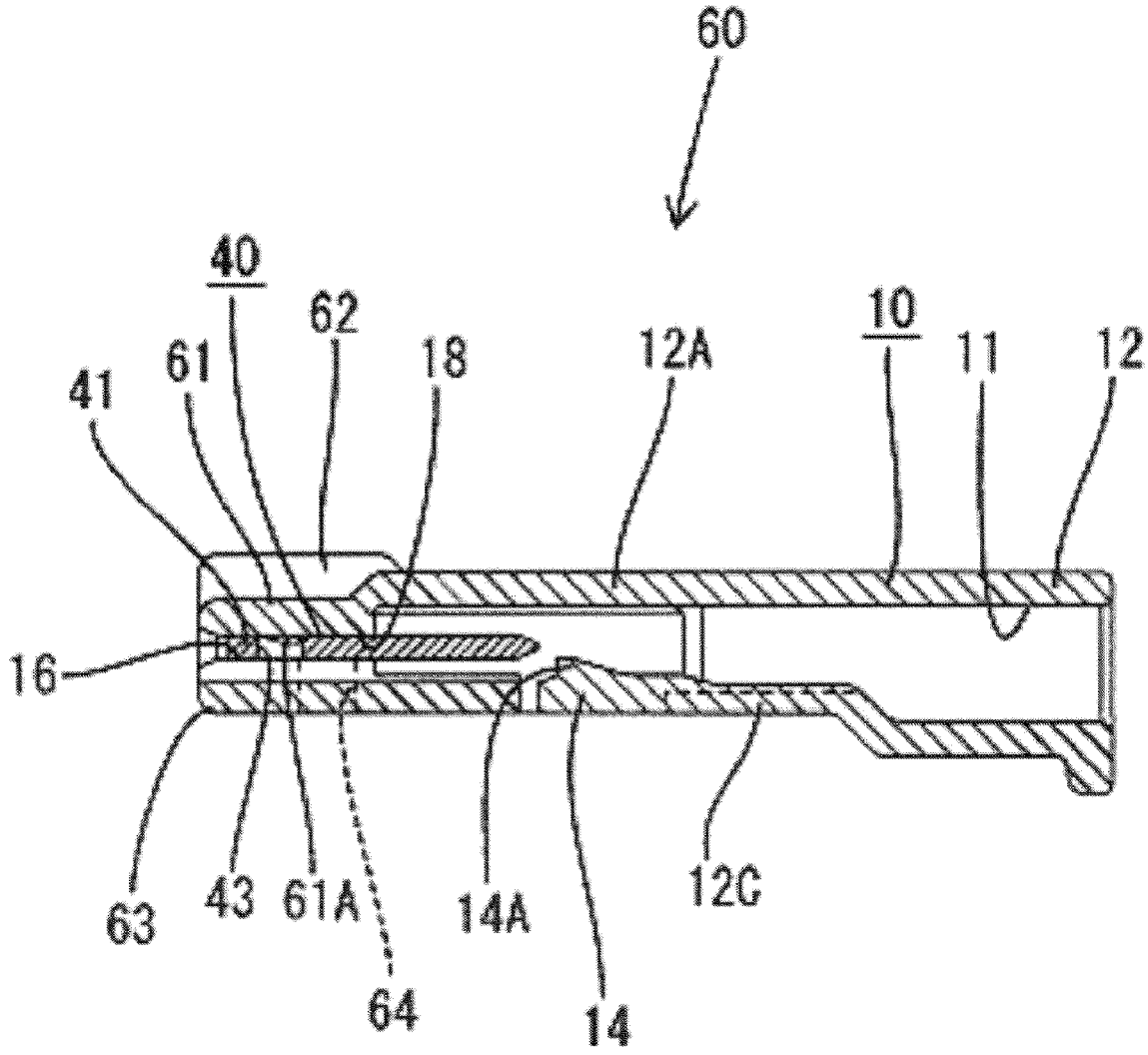
FIG. 14 is a side view in section showing the joint connector.
Figure 15:
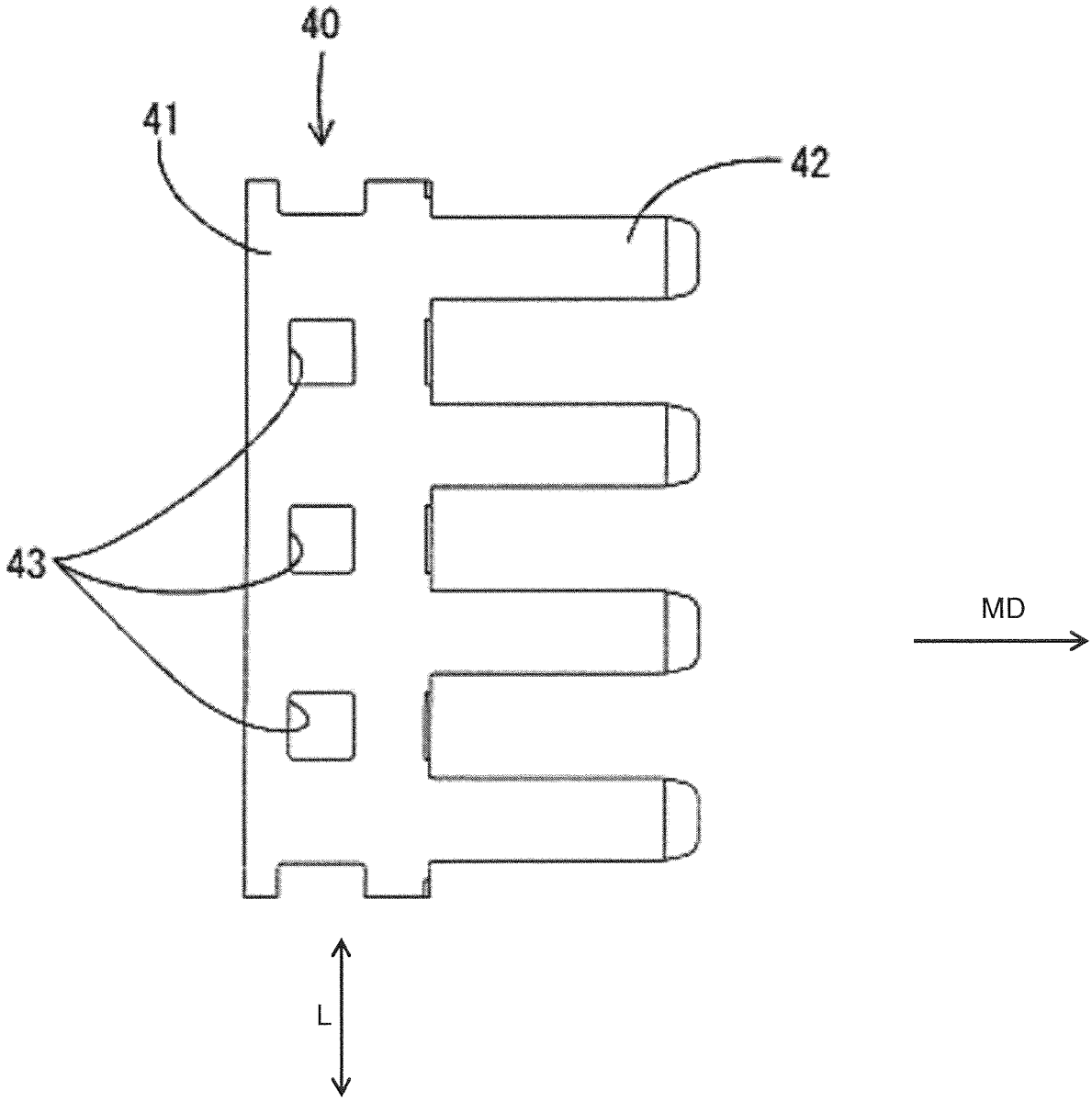
FIG. 15 is a plan view of the joint terminal.
Figure 16:
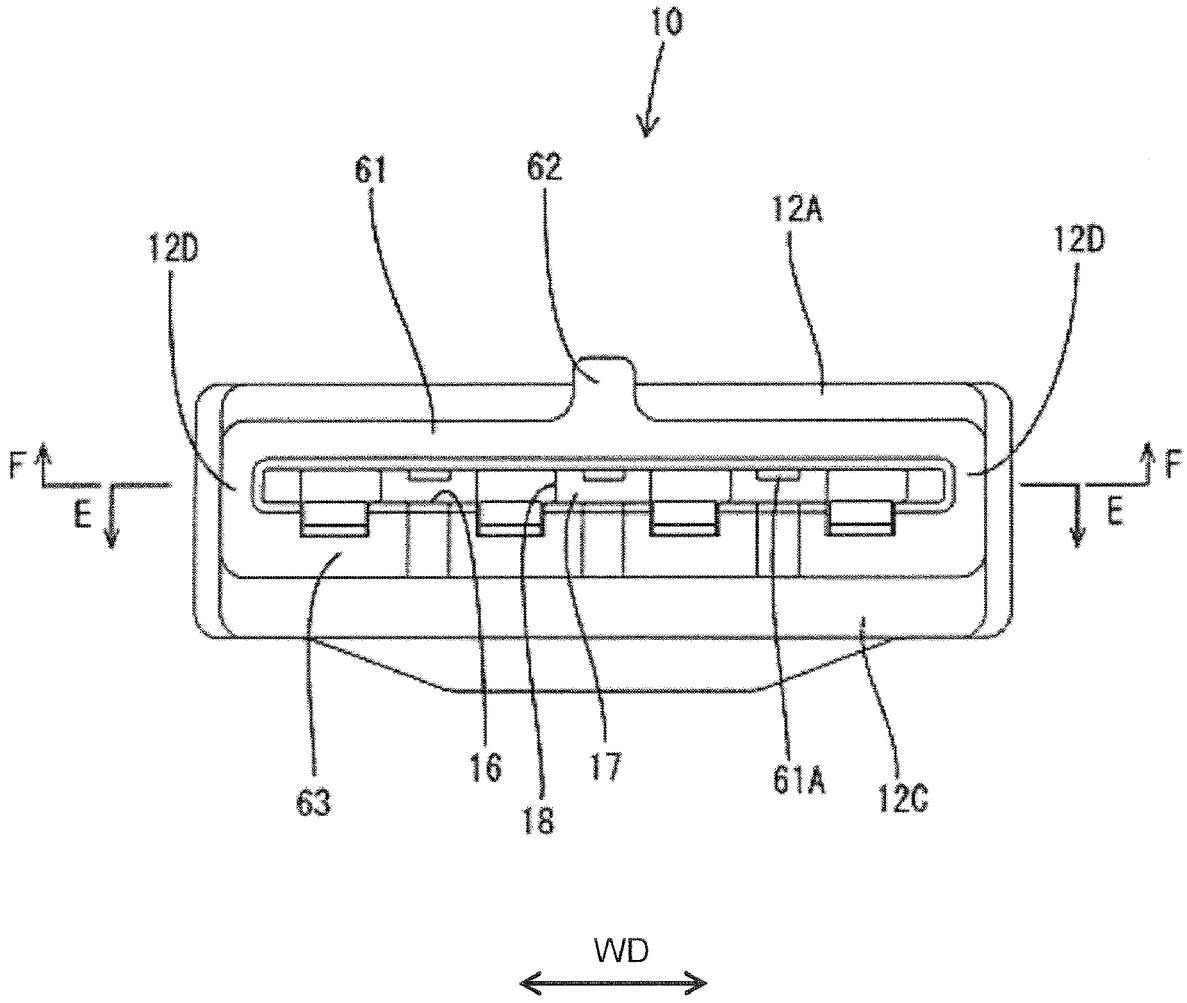
FIG. 16 is a front view of the connector housing.
Figure 17:
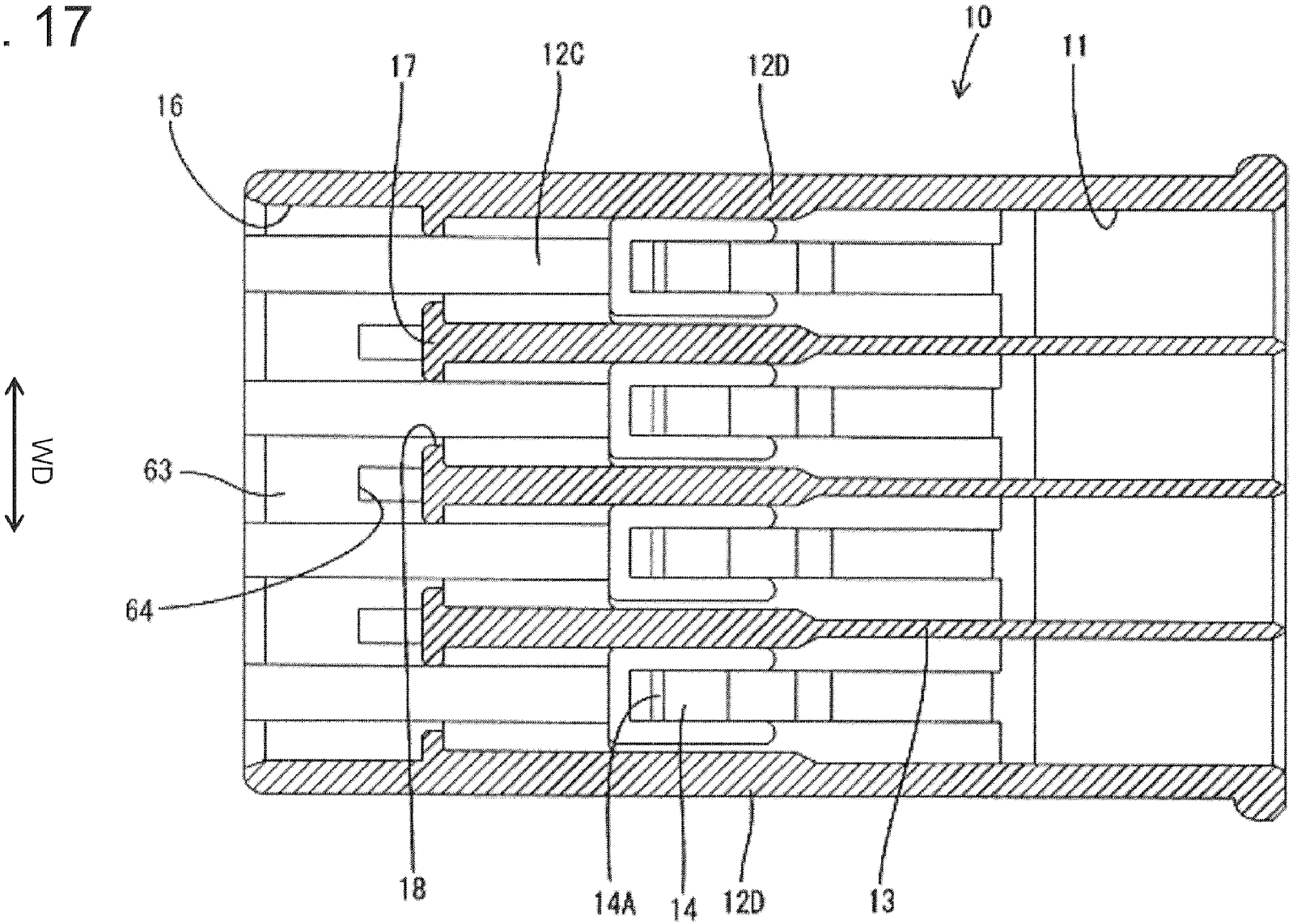
FIG. 17 is a section along E-E of FIG. 16.
Figure 18:
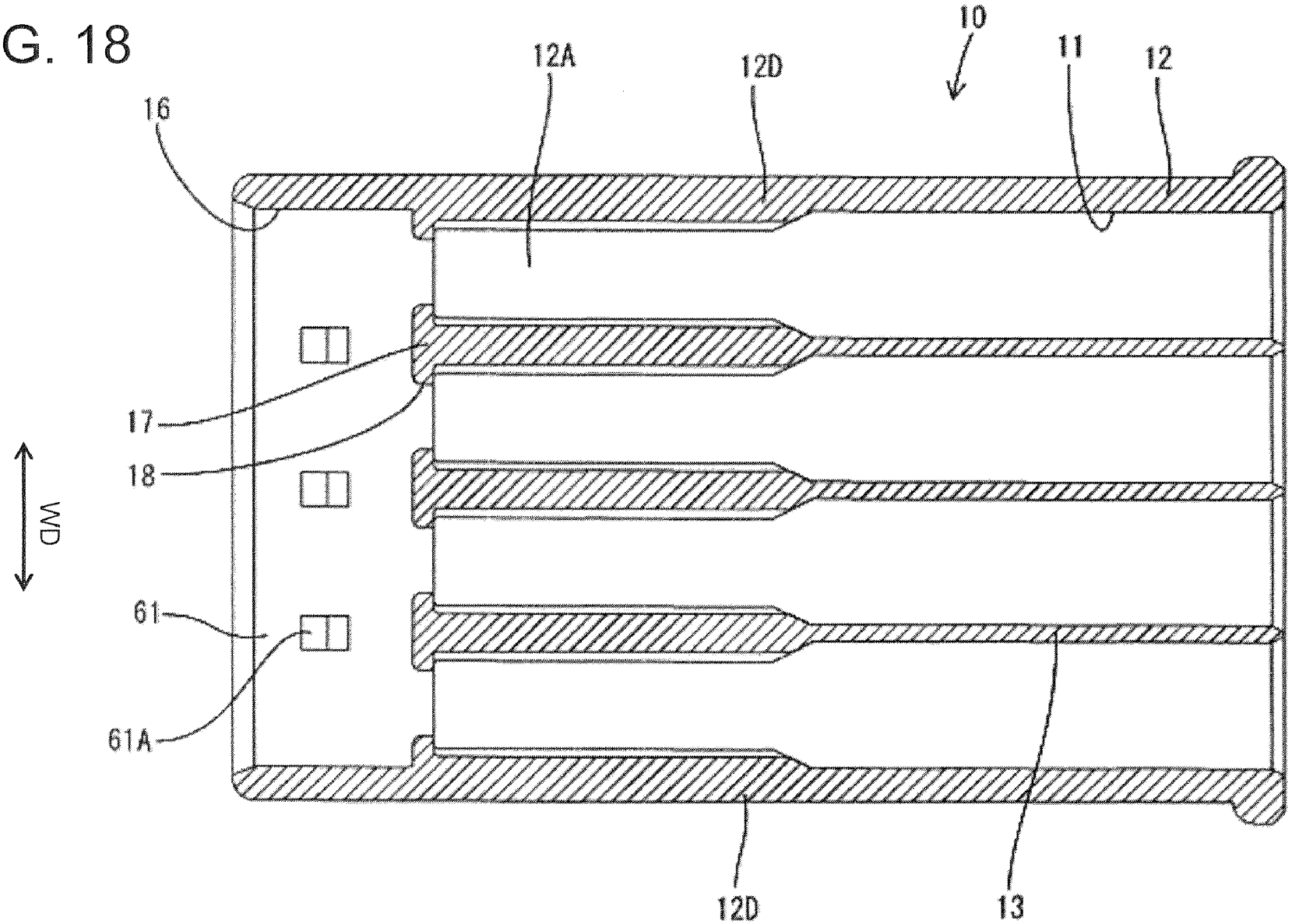
FIG. 18 is a section along F-F of FIG. 18.
Figure 19:
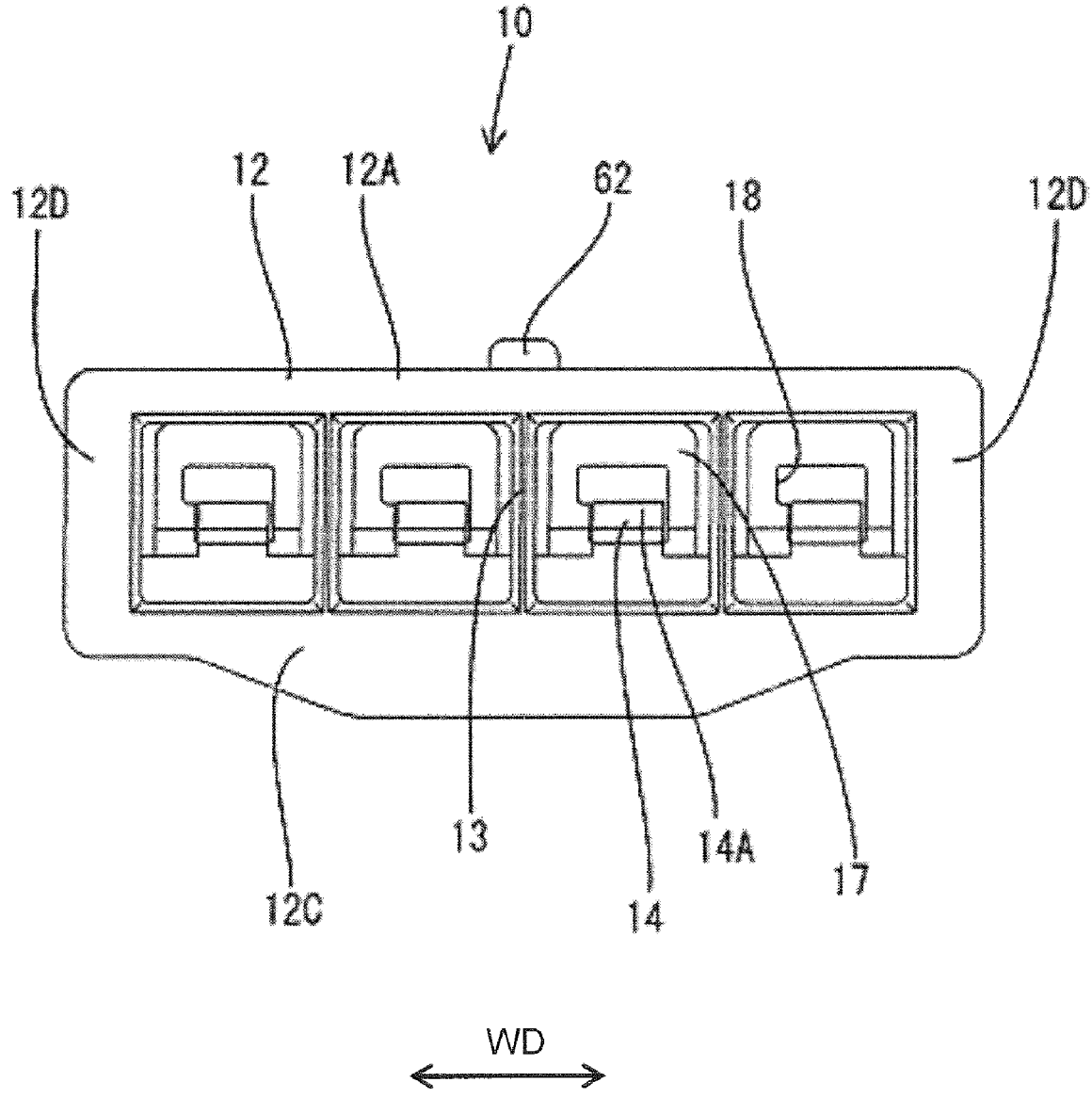
FIG. 19 is a rear view of the connector housing.
Figure 20:
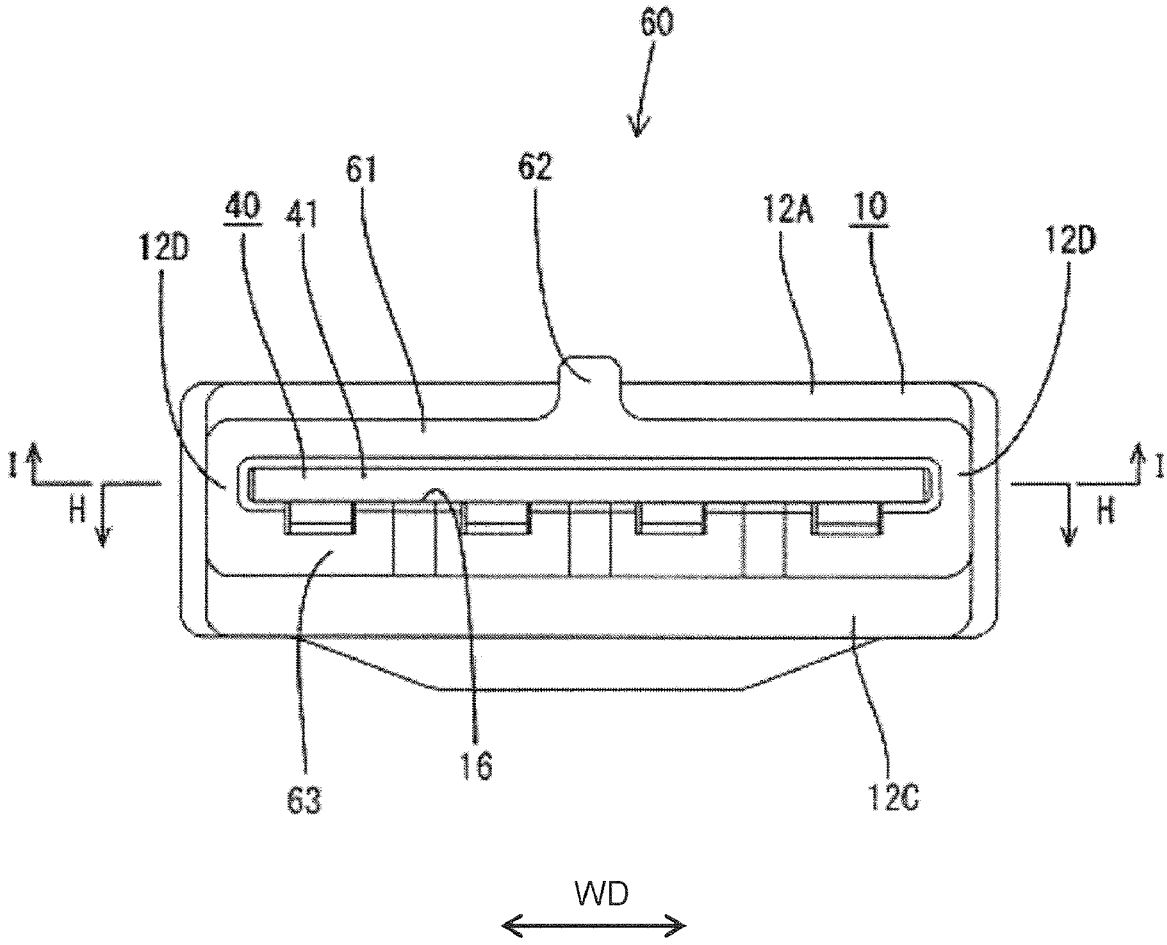
FIG. 20 is a front view of the joint connector.
Figure 21:
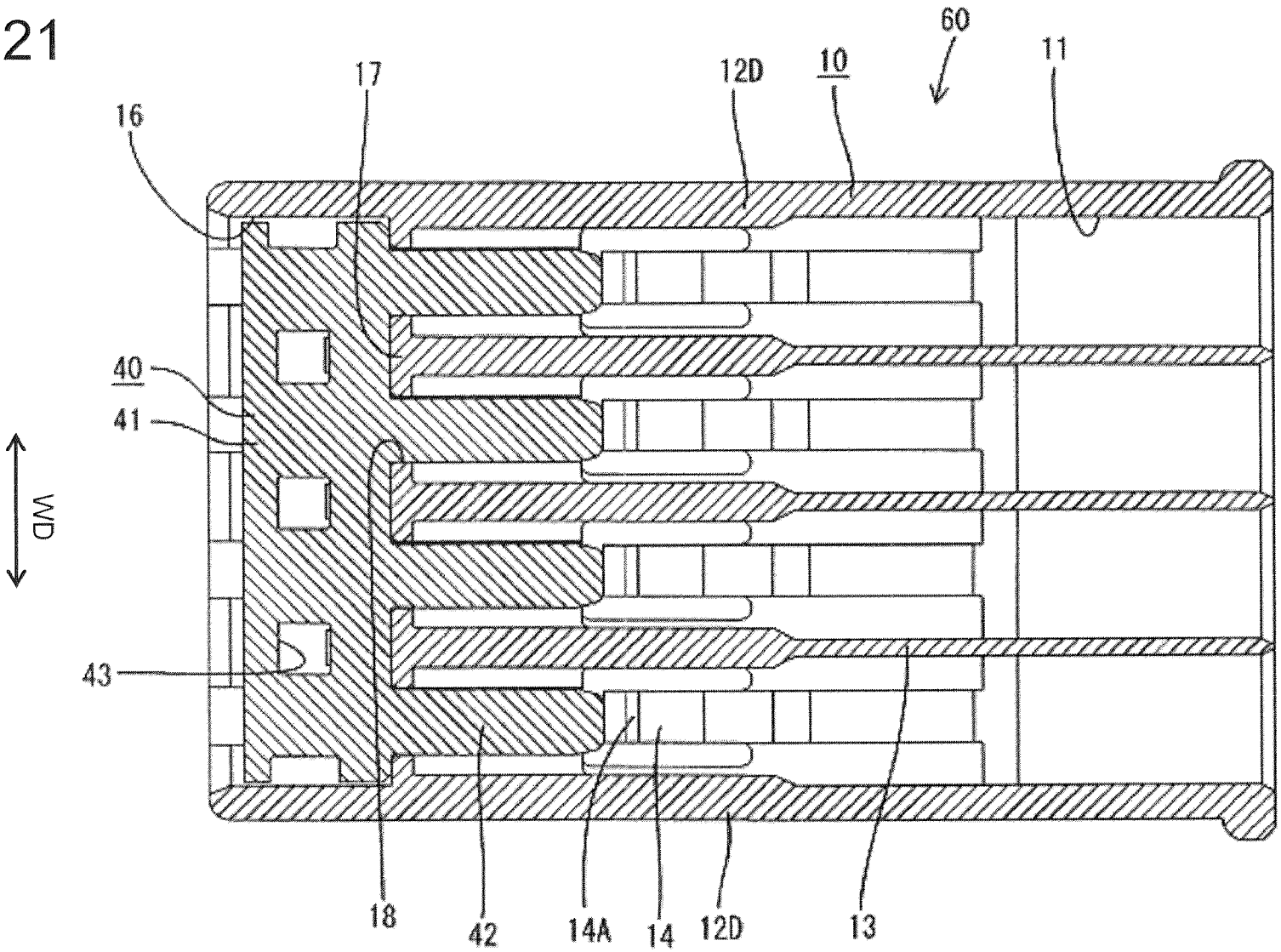
FIG. 21 is a section along H-H of FIG. 20.

First openings 23 penetrate the resilient wall 19 vertically in the thickness direction at positions behind the respective engaging projections 19A (see FIG. 8). The first openings 23 are substantially rectangular and are slightly wider than the planar shape of the engaging projections 19A. Second openings 24 penetrate the cover 21 in the thickness direction at positions right above the first openings 23 of the resilient wall 19. The second openings 24 have substantially the same shape and size as the first openings 23. The first and second openings 23, 24 provide vertical communication between the mounting portion 16 and the outside of the housing 10.

The terminal portions 42 of the joint terminal 40 are inserted into the mounting portion 16 of the housing 10 from the front and are moved along the mounting direction MD into the respective insertion openings 18. As a result, the terminal portions 42 move laterally between the engaging projections 19A on the resilient wall 19.

The strip-like base 41 of the joint terminal 40 is inserted into the mounting portion 16 of the housing 10 and portions of the rear edge of the base 41 between the terminal portions 42 reach the front edges of the engaging projections 19A. The joint terminal 40 is pushed further so that the rear of the base 41 slips under the engaging projections 19A and deforms the resilient wall 19 up and out into the clearance S. The engaging holes 43 are directly below the engaging projections 19A when the joint terminal 40 is inserted in the mounting direction MD to a proper position. As a result, the resilient wall 19 restores resiliently so that the engaging projections 19A enter the respective engaging holes 43 (see FIGS. 11 and 12) to fix the joint terminal 40 in the housing 10. The entire strip-like base 41 is accommodated in the mounting portion 16 and the terminal portions 42 project entirely into the cavities 11 when the joint terminal 40 is mounted at the proper position.

The engaging holes 43 penetrate the strip-like base 41 at positions between the terminal portions 42. The resilient wall 19 is continuous with the left and right side wall portions 12D of the housing 10 and the engaging projections 19A project from the resilient wall 19. The engaging portions 19 are engageable with the respective engaging holes 43. In this way, the joint terminal 40 is mounted rearwardly into the front end of the housing 10 along the mounting direction MD, which preferably is opposite to the inserting direction of the terminals 30 into the housing 10, and causes the resilient wall 19 to deform into the clearance S. The resilient wall 19 restores resiliently when the joint terminal 40 reaches the proper position so that the engaging projections 19A enter the engaging holes 43. The engagement of the engaging projections 19A and the engaging holes 43 fixes the joint terminal 40 in the housing 10. Thus, the press-fitting portion required to fix the prior art joint terminal in the prior art housing becomes unnecessary and the joint connector C can be miniaturized by that much.

The engaging holes 43 are located between the terminal portions 42, and hence the engaging projections 19A of the housing 10 are at positions laterally displaced or offset from paths for the terminal portions 42 when the joint terminal 40 is mounted. Thus, the terminal portions 42 do not slide in contact with the engaging projections 19A when the joint terminal 40 is inserted. Accordingly, the engaging projections 19A will not deform the terminal portions 42 and resin of the engaging projections 19A will not adhere to the terminal portions 42.

A joint connector with cantilevered locking lances could be considered instead of a conventional press-fit joint connector. These locking lances could extend back from an upper wall of a housing and could fix a joint terminal by engaging the joint terminal in a manner similar to the locking lances 14 for retaining the terminals 30. A press-fitting margin would not be necessary and the joint connector could be miniaturized by that much. However, base ends of the cantilevered locking lances with an outer wall of the housing require more strength than locking lances supported at both ends, and the thickness of the locking lances in a resilient deforming direction must be increased. Therefore, the housing cannot be miniaturized sufficiently.

However, at least the opposite widthwise ends of the resilient wall 19 are connected with the outer wall 12 of the housing 10 in this embodiment. Thus, the thickness can be decreased as compared with the above cantilevered locking lances 14 and the housing 10 can be miniaturized sufficiently.

At least one column 22 preferably is provided between the resilient wall 19 and the cover 21 to reduce the span of the resilient wall 19. Thus, the thickness of the resilient wall 19 can be reduced so that the joint connector C can be miniaturized further.

The cover 21 is provided at the side of the resilient wall 19 opposite the engaging projections 19A and the clearance S permits the resilient deformation of the resilient wall 19. The cover 21 covers the resilient wall 19 and hence the cover 21 does not need to be as strong as the outer wall 12 and may have a minimum rigidity sufficient to hold the joint terminal 40. Therefore, resistance due to a resilient restoring force of the resilient wall 19 during the insertion of the joint terminal 40 can be reduced.

The joint terminal 40 is produced by press-working the metal plate and the engaging holes 43 are the feed holes 51 used to feed the metal plate material during press working. A provision of engaging holes 43 in addition to the feed holes 51 would require the strip-like base portion 41 to be provided in addition to the carrier 52. Thus, a larger metal plate material is necessary and a separate processing would be required to form the engaging holes 43. However, the feed holes 51 are utilized as the engaging holes 43, and it is not necessary to increase of the material and to increase processing labor.

A wiring harness of a second embodiment of the invention is illustrated in FIGS. 13 to 22. The wiring harness of this embodiment differs from the first embodiment in that the cover 21 of the first embodiment is not present in the second embodiment. Elements of the second embodiment that are the same as or similar to the first embodiment are identified by the same reference numerals but are not described again.

The joint connector 60 according to this embodiment is provided with a housing 10 internally formed with cavities 11 for accommodating mating terminals 30 and a joint terminal 40 for connecting and shorting the mating terminals 30 in the cavities 11, similar to the first embodiment.

Similar to the first embodiment, the housing 10 has a flat box shape and four cavities 11 are formed substantially side by side in a width direction WD of the housing 10. An outer wall 12 of the housing 10 is formed with four locking lances 14 that are substantially side by side on a lower wall portion 12C of the outer wall 12 of the housing 10. Each locking lance 14 is cantilevered forward and is resiliently deformable vertically in and out in directions intersecting an insertion direction of the terminals 30 of the housing 10 (see FIG. 14). Similar to the first embodiment, a lock 14A is formed at the free front end of each locking lance 14 for retaining the terminal 30 in the cavity 11 by engaging an engageable portion 33 of the terminal 30.

Similar to the first embodiment, the joint terminal 40 is produced from an electrical conductive metal plate that is formed beforehand with substantially rectangular feed holes 51 that penetrate the metal plate in the thickness direction. The metal plate then is punched out or stamped by a press to form a strip-like base 41 and four terminal portions 42 that project from the base 41 at specified intervals. The terminal portions 42 project in the mounting direction MD (see FIG. 15), which is substantially normal to the longitudinal direction L of the strip-like base 41. The feed holes 51 in the strip-like base 41 define engaging holes 43 engageable with engaging projections 61A. Similar to the first embodiment, the engaging holes 43 are in parts of the strip-like base 41 laterally displaced or offset from extensions of the terminal portions 42.

Similar to the first embodiment, the joint terminal 40 is mounted in the mounting direction MD into a front end portion of the housing 10 with the terminal portions 42 in the lead (i.e. the terminal portions 42 project backward). Similar to the first embodiment, the front end of the housing 10 is formed with a mounting portion 16 into which the strip-like base 41 of the joint terminal 40 is to be mounted. A partition wall 17 of the housing 10 partitions the mounting portion 16 and the cavities 11 and has insertion openings 18 that provide communication between the mounting portion 16 and the respective cavities 11.

Similar to the first embodiment, the resilient wall 61 is provided above the mounting portion 16. More particularly, the resilient wall 61 is a front end portion of an upper wall portion 12A and the opposite left and right edges thereof are continuous with left and right side wall portions 12D of the housing 10. The resilient wall 61 has a wall thickness substantially equal to that of the remainder of the upper wall portion 12A and is displaced down and in from the upper wall portion 12A by about the wall thickness thereof. The outer surface of the upper wall portion 12A is stepped down toward the resilient wall 61 and the thickness of a stepped part between the resilient wall 61 and the upper wall portion 12A is smaller than the wall thicknesses of the other parts.

A projection 62 is provided on the upper surface of the resilient wall 61. The projection 62 is at a substantially widthwise central position of the resilient wall 61 and is long and narrow in forward and backward directions. The projection 62 extends from the front end to the rear end of the resilient wall 61, and the rear end thereof reaches the stepped part of the upper wall portion 12A. The height (projecting distance from the resilient wall 61) of the projection 62 is substantially constant over substantially the entire length. The upper surface of the projection 62 is above that of the upper wall portion 12A.

The engaging projections 61A engageable with the respective engaging holes 43 of the joint terminal 40 are provided on the lower surface (surface toward the mounting portion 16) of the resilient wall 61. More particularly, three engaging projections 61A are provided substantially side by side in a width direction WD of the resilient wall 61 and located substantially before (or widthwise corresponding to, but located forward of) dividing wall portions 13 of the housing 10 (see FIG. 16). The middle one of the three engaging projections 61A is located right below the projection 62.

Figure 22:
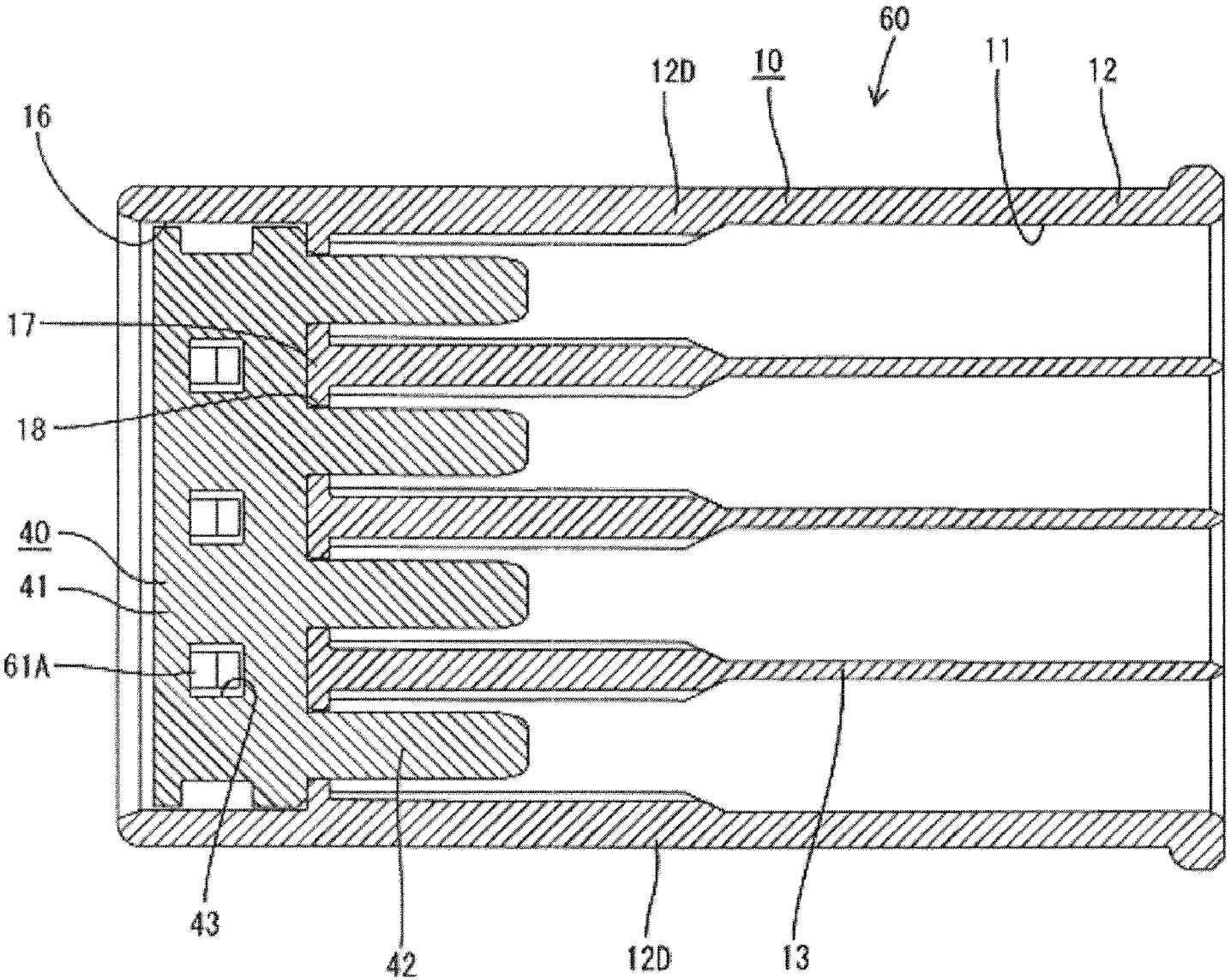
FIG. 22 is a section along I-I of FIG. 20.

The engaging projections 61A project down and in from the lower surface of the resilient wall 61 and have a substantially rectangular shape slightly smaller, but preferably slightly longer in forward and backward directions than that of the engaging holes 43 when viewed from below (see FIG. 22). The width of the engaging projections 61A preferably is slightly smaller than the width of parts of the partition wall 17 left between the adjacent terminal-portion insertion openings 18. The width of the projection 62 is slight larger than that of the engaging projections 61A.

The rear end surfaces of the engaging projections 61A are substantially at right angles to or steeply inclined with respect to the lower surface of the resilient wall 61, the front surfaces thereof are inclined to gradually reduce a projecting distance toward the front and the bottom end surfaces thereof are substantially parallel to the lower surface of the resilient wall 61. A projecting distance of the engaging projections 61A preferably is slightly shorter than substantially half the plate thickness of the joint terminal 40.

A facing wall 63 is below the resilient wall 61 and faces the resilient wall 61. The facing wall 63 is formed by a front end portion of the lower wall portion 12C of the housing 10. The facing wall 63 and the remainder of the lower wall portion 12C have the same wall thickness and the outer surfaces of the facing wall 63 and the remainder of the lower wall portion 12C form a flat surface (see e.g. FIG. 14).

The facing wall 63 is formed with openings 64. The openings 64 are at positions displaced backward from the engaging projections 61A, preferably have a substantially rectangular shape long in forward and backward directions than the planar shape of the engaging projections 61A and penetrate the facing wall 63 vertically in a wall thickness direction (see FIG. 17). By the openings 64, the mounting portion 16 and the outside of the housing 10 vertically communicate with each other.

As described above, according to this embodiment, the strip-like base 41 of the joint terminal 40 is formed with the engaging holes 43 at the positions located between the terminal portions 42, and the engaging projections 61A engageable with the engaging holes 43 project from the resilient wall 61 continuous with the left and right side wall portions 12D of the housing 10. Thus, similar to the first embodiment, the joint terminal 40 is mounted in the mounting direction MD into the front end portion of the connector housing 10 from front preferably while resiliently deforming the resilient wall 61, and the resilient wall 61 is resiliently at least partly restored to engage the engaging projections 61A with the engaging holes 43 when the joint terminal 40 is mounted at a substantially proper position. In other words, since the joint terminal 40 is fixed or positioned in the housing 10 by the engagement of the engaging projections 61A and the engaging holes 43, the connector housing 10 requires no conventional press-fitting portion, wherefore the joint connector 60 can be miniaturized by that much. Similar to the first embodiment, since the engaging holes 43 are located between the terminal portions 42, i.e. the engaging projections 61A of the housing 60 are located lateral to paths for the terminal portions 42 when the joint terminal 40 is mounted, sliding contact of the terminal portions 42 with the engaging projections 61A can be prevented when the joint terminal 40 is inserted.

The invention is not limited to the above described and illustrated embodiments. For example, the following embodiments are also included in the technical scope of the present invention.

Figure 23:
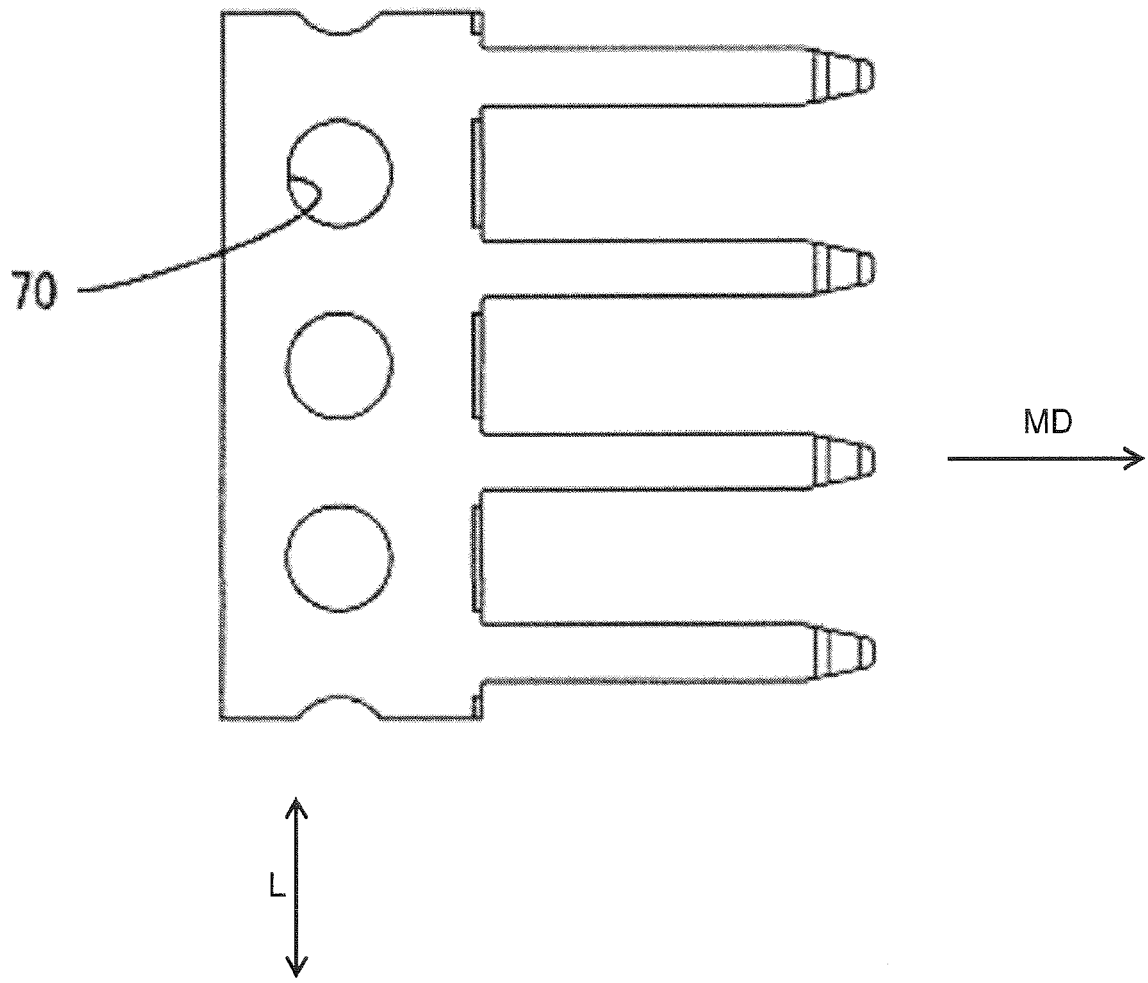
FIG. 23 is a plan view of a joint terminal according to another embodiment (1).

The engaging holes of the joint terminal 40 are substantially rectangular in the first embodiment. However, they may have other shapes, such as the round shape shown in FIG. 23, or any other shape such as a polygonal shape, oval shape or the like.

The column 22 is provided only at the widthwise central position of the resilient wall 19 in the first embodiment. However, the invention is not limited thereto and the number and positions of the columns do not matter.

The opposite left and right edges of the resilient wall 19 are continuous with the left and right side wall portions 12D and the rear end thereof is substantially continuous with the partition wall 17 in the first embodiment. However, only the opposite left and right edges of the resilient wall may be continuous with the side wall portions of the housing and the rear end thereof may be separated from the partition wall.

The feed holes 51 and the terminal portions 42 are provided at the same pitches in the above embodiments. However, it is sufficient to form the engaging holes between the terminal portions and the arrangement pitches may not necessarily be the same.

What is claimed is:

1. A joint connector, comprising:

a housing formed with left and right side wall portions and cavities between the side wall portion for accommodating mating terminals, insertion openings formed in the housing and communicating with the cavities, a resilient wall continues with the left and right side wall portions and engaging projections projecting from the resilient wall at positions offset from the insertion openings; and a joint terminal with a strip-shaped base and terminal portions projecting at specified intervals from the base, the terminal portions being inserted through the insertion openings and into the cavities, the base being formed with engaging holes at positions offset from the terminal portions, the engaging projections of the housing engaging the engaging holes for fixing the joint terminal in the housing.

2. The joint connector of claim 1, wherein the entire strip-shaped base is accommodated in housing.

3. The joint connector of claim 1, wherein the housing has a cover spaced from a side of the resilient wall opposite to the engaging projections to define a clearance for permitting resilient deformation of the resilient wall.

4. The joint connector of claim 3, wherein the housing has at least one column between the resilient wall and the cover.

5. The joint connector of claim 1, wherein the joint terminal is produced by press-working a conductive plate, and the engaging holes defining feed holes to feed the conductive plate during press working.

6. A wiring harness, comprising:

the joint connector of claim 1;

mating terminals in the cavities; and wires connected to the mating terminals, the terminal portions of the joint terminal selectively connecting specified ones of the mating terminals for shorting the mating terminals.

* * * * *